US012222177B2

(12) United States Patent
Klein

(10) Patent No.: US 12,222,177 B2
(45) Date of Patent: Feb. 11, 2025

(54) RIFLE CONVERSION DEVICES AND METHOD

(71) Applicant: Thomas Edward Klein, West Chester, PA (US)

(72) Inventor: Thomas Edward Klein, West Chester, PA (US)

( * ) Notice: Subject to any disclaimer, the term of this patent is extended or adjusted under 35 U.S.C. 154(b) by 131 days.

(21) Appl. No.: 17/061,481

(22) Filed: Oct. 1, 2020

(65) Prior Publication Data

US 2022/0107154 A1 Apr. 7, 2022

(51) Int. Cl.
*F41A 21/48* (2006.01)
*F41C 23/16* (2006.01)

(52) U.S. Cl.
CPC ..... *F41A 21/48* (2013.01); *F41C 23/16* (2013.01)

(58) Field of Classification Search
CPC ..... F41A 3/66; F41A 9/60; F41A 9/63; F41A 9/68; F41A 17/54; F41A 21/48; F41C 23/16; F41G 11/004
USPC ..... 42/75.01, 75.03, 90, 97, 98, 99, 106; 89/33.4, 36.06, 40.06
See application file for complete search history.

(56) References Cited

U.S. PATENT DOCUMENTS 3,771,415 A 11/1973 Into et al.
4,100,694 A * 7/1978 Musgrave ..... F41A 17/38 42/106
4,594,803 A * 6/1986 Muncy ..... F41A 9/60 42/98
4,663,876 A 5/1987 Reaume
5,305,539 A 4/1994 Von Kuster
(Continued)

FOREIGN PATENT DOCUMENTS

CA 2602558 A1 10/2006
EP 2697593 B1 3/2018
(Continued)

OTHER PUBLICATIONS

Bravo Company AR-15 Complete Lower Receiver W/ Bcmgunfighter™ Stock, https://www.brownells.com/rifle-parts/receiver-parts/receivers/lower-receivers/ar-15-complete-lower-receiver-w-bcmgunfighter-stock-prod83804.aspx, Jun. 11, 2020.
(Continued)

*Primary Examiner* — Joshua E Freeman
*Assistant Examiner* — Benjamin S Gomberg
(74) *Attorney, Agent, or Firm* — Bonini IP Law, LLC; Frank J. Bonini, Jr.

(57) ABSTRACT

Conversion devices and methods for converting a chassis style rifle to function as a traditional bolt style rifle. The conversion device includes a conversion component that attaches to a standard or modified standard lower receiver of a rifle to allow the rifle to remain capable of being used as either a chassis gun or standard rifle configuration as desired by the operator. The conversion component may attach to the magazine well of the rifle. The conversion component is removably installable on the lower receiver, and accessories, such as a forearm or handguard, may be removably attached to a conversion component and are supported by the lower receiver. The configuration eliminates the need to contact the upper receiver during the act of firing a shot, particularly for gripping with the off-hand or resting on separate shooting accessories. The accuracy and precision of the rifle are enhanced.

30 Claims, 20 Drawing Sheets

(56) References Cited

U.S. PATENT DOCUMENTS

| | | | | |
|---|---|---|---|---|
| 5,711,102 | A | 1/1998 | Plaster et al. | |
| 6,070,352 | A | 6/2000 | Daigle | |
| 6,763,755 | B2 * | 7/2004 | Johnson | F41A 3/12 42/90 |
| 7,059,076 | B2 | 6/2006 | Stoner et al. | |
| 7,131,228 | B2 | 11/2006 | Hochstrate et al. | |
| RE39,465 | E | 1/2007 | Swan | |
| 7,313,883 | B2 | 1/2008 | Leitner-wise | |
| 7,428,795 | B2 * | 9/2008 | Herring | F41A 3/66 42/75.01 |
| 7,574,823 | B2 | 8/2009 | Nakayama | |
| 7,640,689 | B2 | 1/2010 | Fluhr | |
| 7,716,865 | B2 | 5/2010 | Daniel et al. | |
| D623,253 | S * | 9/2010 | Hoffman | D22/108 |
| 7,793,452 | B1 | 9/2010 | Samson et al. | |
| 7,810,271 | B2 | 10/2010 | Patel | |
| 7,823,312 | B2 * | 11/2010 | Faifer | F41A 9/61 42/49.02 |
| 7,926,217 | B2 | 4/2011 | Mccann | |
| 8,051,595 | B2 | 11/2011 | Hochstrate et al. | |
| 8,205,373 | B1 * | 6/2012 | Ubl | F41C 23/16 42/71.01 |
| 8,640,372 | B2 | 2/2014 | Hochstrate et al. | |
| 8,931,196 | B1 | 1/2015 | Larue | |
| 8,931,197 | B2 | 1/2015 | Larson | |
| 9,003,686 | B2 | 4/2015 | Brown | |
| 9,175,923 | B2 * | 11/2015 | Ruby | F41A 9/64 |
| 9,194,635 | B1 | 11/2015 | Gibbens et al. | |
| 9,207,041 | B1 | 12/2015 | Bast | |
| 9,228,799 | B2 | 1/2016 | Kuczynko | |
| 9,716,226 | B2 | 7/2017 | Gealy et al. | |
| 9,797,666 | B2 | 10/2017 | Schuetz | |
| 10,101,109 | B2 * | 10/2018 | Caudle | F41A 11/02 |
| 10,132,583 | B2 | 11/2018 | Drake | |
| 10,203,178 | B2 | 2/2019 | Drake | |
| 10,215,519 | B2 | 2/2019 | Drake | |
| 10,386,139 | B1 * | 8/2019 | Sharps | F41A 17/38 |
| 10,443,963 | B1 | 10/2019 | Grange et al. | |
| 10,520,269 | B2 | 12/2019 | Hochstrate et al. | |
| 10,598,450 | B1 * | 3/2020 | Welch | F41A 3/66 |
| 10,684,086 | B2 * | 6/2020 | Churchill | F41A 9/60 |
| 10,739,099 | B2 * | 8/2020 | Bowman | F41A 23/10 |
| 11,927,416 | B2 * | 3/2024 | Sanders | F41C 23/02 |
| 2009/0056191 | A1 | 3/2009 | Battaglia | |
| 2010/0126054 | A1 | 5/2010 | Daniel et al. | |
| 2010/0186278 | A1 | 7/2010 | Daniel | |
| 2011/0185617 | A1 * | 8/2011 | Brixius | F41C 23/16 42/71.01 |
| 2012/0291329 | A1 | 11/2012 | Ubl et al. | |
| 2013/0014418 | A1 | 1/2013 | Dextraze et al. | |
| 2014/0230297 | A1 | 8/2014 | Larson, Jr. et al. | |
| 2015/0101230 | A1 | 4/2015 | Curtis | |
| 2015/0184976 | A1 | 7/2015 | Kuczynko | |
| 2015/0267979 | A1 | 9/2015 | Miller et al. | |
| 2016/0209136 | A1 | 7/2016 | Schuetz | |
| 2017/0122684 | A1 | 5/2017 | Drake | |
| 2018/0202760 | A1 | 7/2018 | Drake | |
| 2019/0093968 | A1 | 3/2019 | Drake | |
| 2019/0178608 | A1 | 6/2019 | Drake | |
| 2020/0256637 | A1 * | 8/2020 | Leslie | F41G 1/545 |
| 2020/0284535 | A1 * | 9/2020 | Drake | F41C 23/16 |
| 2021/0278153 | A1 * | 9/2021 | Heuss | F41A 3/66 |
| 2021/0372733 | A1 * | 12/2021 | Hall | F41G 1/35 |
| 2023/0160650 | A1 * | 5/2023 | Douvier | F41A 11/02 42/75.01 |

FOREIGN PATENT DOCUMENTS

| | | | |
|---|---|---|---|
| WO | 2006103062 | A1 | 10/2006 |
| WO | 2010042262 | A2 | 4/2010 |
| WO | 2015006583 | A1 | 1/2015 |

OTHER PUBLICATIONS

Spikes Tactical AR-15 Hellbreaker Lower Receiver Billet, https://www.brownells.com/rifle-parts/receiver-parts/receivers/lower-receivers/ar-15-hellbreaker-lower-receiver-billet-prod109998.aspx, Jun. 11, 2020.

Stocking Up—A Rifle Chassis Buyer's Guide Featuring Seven Popular Options, https://www.recoilweb.com/stocking-up-a-chassis-buyers-guide-featuring-seven-popular-options-155396.html, Sep. 21, 2020.

"The Arsenal: Building An Assault Rifle | 21st Century Asian Arms Race", https://21stcenturyasianarmsrace.com/2013/11/03/the-arsenal-building-an-assault-rifle/, May 11, 2020.

"What is the difference between an upper and lower receiver on firearms?—Quora", https://www.quora.com/What-is-the-difference-between-an-upper-and-lower-receiver-on-firearms, Sep. 21, 2020.

* cited by examiner

AR-15 Chassis Conversion As a Temporary Fixture

Step 1: The host rifle's lower receiver assembly remains free of the invention. This is the standard rifle configuration for AR pattern rifles.

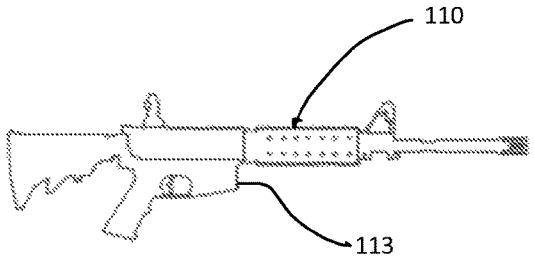

Step 2: When the user desires chassis-like performance, they add the subject invention's temporary components to the host rifle's lower receiver assembly.

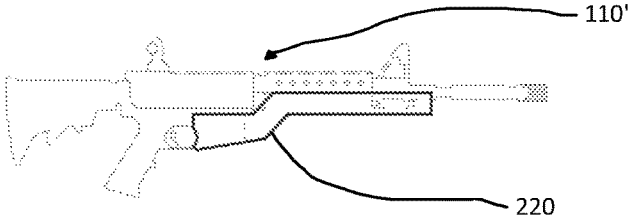

Step 3: When the user desires the standard AR pattern rifle configuration, they remove the subject invention's temporary components.

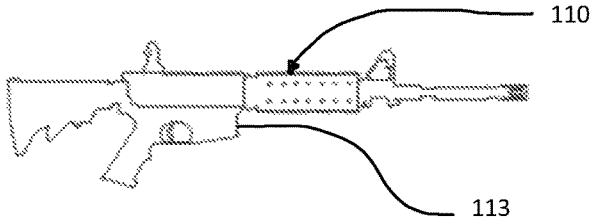

Fig. 3

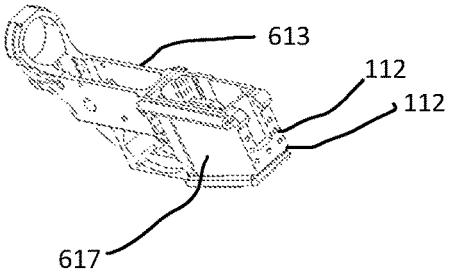
Fig. 22
Fig. 23
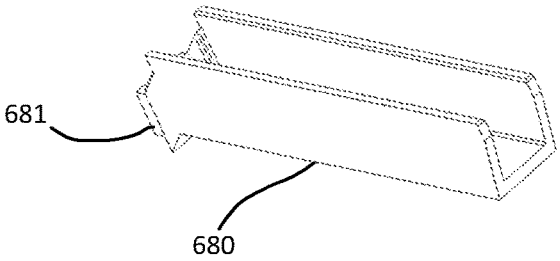
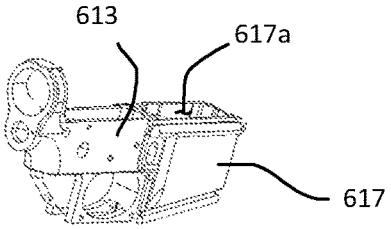
Fig. 24
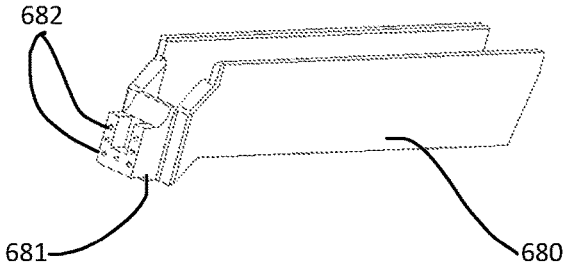
Fig. 25
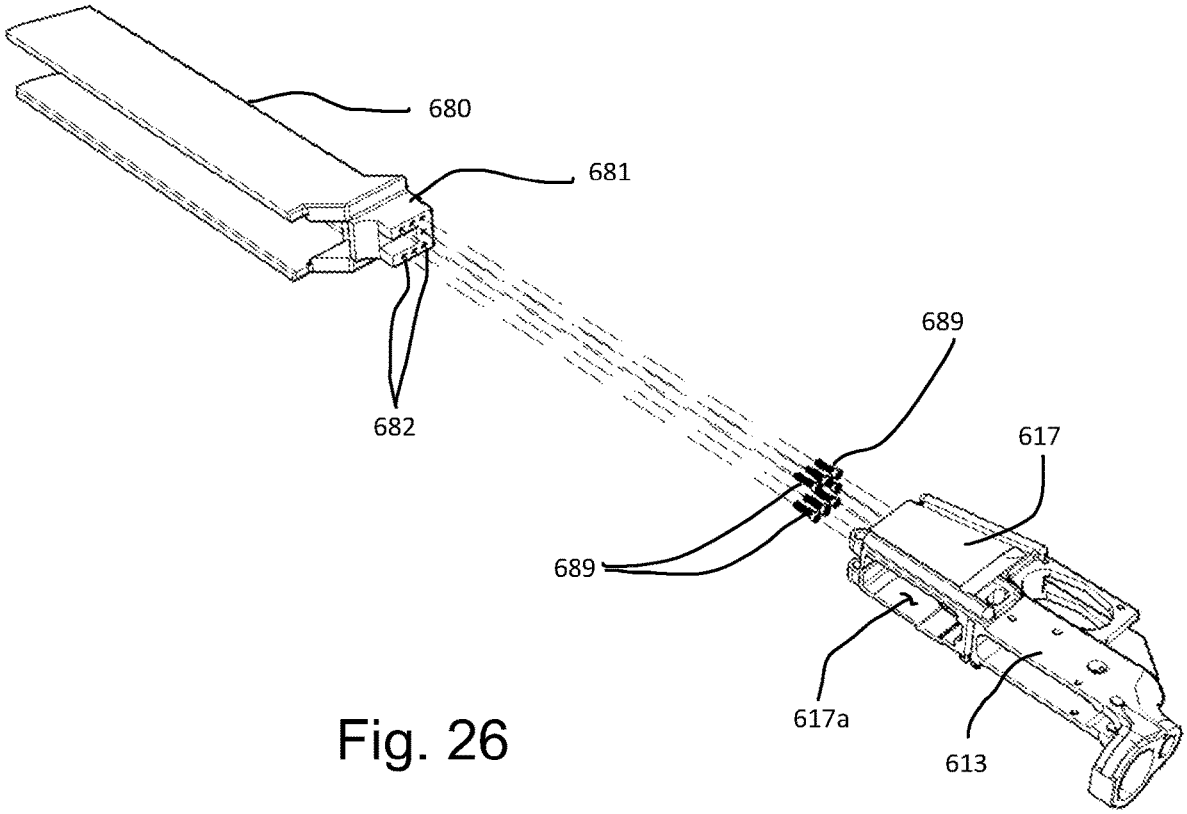
Fig. 26

KEY:

FORWARD PASS

REVERSE PASS

X FORWARD PASS CONFIGURATION STATE

X BACKWARD PASS CONFIGURATION STATE

RIFLE CONVERSION DEVICES AND METHOD

BACKGROUND OF THE INVENTION

1. Field of the Invention

The present invention relates to the field of firearms, and more particularly to methods and devices for converting an automatic style of rifle to achieve the form and benefits of a bolt-action style rifle but with auto-loading rates of fire and common automatic rifle parts.

2. Brief Description of the Related Art

It is common for high-power automatic rifles to be utilized by law-enforcement, military and competitive shooters. An example of a high-power tactical rifle is the AR-15 platform. There are a number of different tactical rifles on the market, including those that are modified. One difference between a tactical rifle and other sport rifles is that the tactical rifle utilizes a pistol style grip in addition to a forward hand grip and buttstock. The AR-15 rifle system or style system, includes a number of derivatives, examples of which include the AR-10 which is provided in .308 caliber, the M-4, as well as other variants. An AR-15 rifle platform typically comprises a lower receiver, a trigger group located in the lower receiver, an upper receiver, a handguard, a pistol grip and a buttstock. The main structural components are the upper and lower receiver elements. The external components include the handguard, pistol grip and the buttstock which attach to the lower receiver and upper receiver, with the pistol grip and buttstock attaching to the lower receiver and the handguard attaching to the upper receiver. The handguard typically encircles the barrel of the rifle. The trigger group or trigger assembly is housed within the lower receiver. There are a number of aftermarket triggers that may be placed within the trigger housing of the lower receiver. Because of the typical design of the automatic rifles, most rifle users consider the rifles to have a handguard, pistol grip and buttstock. In many instances one of the most widely used accessories for attachment to a rifle is a sight or other form of an optic or sighting system. In some instances the sight may include a laser. A laser sight is used which projects a narrowly focused beam of light that is visible on an intended target. Some sights utilize magnifying objectives to maximize performance of the rifle. There are some optical sights that utilize telescopic finders, such as advanced optical combat gunsights (acog's) which attach to an upper receiver.

The AR-15 rifle is different than its predecessor breech-loading rifles, which typically had a single receiver housing both the trigger and reloading mechanism. The AR-15 provides a distinguishing feature of modular construction in order to facilitate the substitution of parts making repairs easier for military rifles. In an AR rifle arrangement, the lower receiver typically includes the trigger guard that is situated ahead of a detachable pistol grip, and behind the magazine well that is designed to receive and hold detachable ammunition magazines. The typical AR rifle lower receiver provides an attachment point for the buttstock and holds the trigger assembly. The trigger assembly includes the hammer. The lower receiver is attached to an upper receiver and may be removably decoupled for cleaning or repair of malfunctions. The AR style rifle upper receiver contains the bolt carrier assembly and is attached to the barrel assembly. Sights are attached to the upper receiver or the barrel assembly. A handguard usually is attached to the upper receiver, and, in some instances, may be attached to the barrel. The handguard functions to enclose the barrel and a gas-operated reloading device. Burnt powder gas is vented from an opening in the barrel near the forward end of the handguard.

There are a couple of styles of AR-15 type rifles. Some AR-15 rifles have been constructed using a direct gas impingement system (DGI), while others are configured using a short-stroke gas piston design. With the DGI style, a tube vents burnt powder gas back into the bolt carrier assembly. The gas expands within the variable volume chamber to force the bolt open. That action ejects the spent cartridge case. The bolt is then closed by the action of a buffer spring, typically located within the buttstock, which pushes the bolt closed and picks up a new cartridge from the magazine. The DGI system is designed to release the unburned smokeless powder residue to minimize the tendency for malfunctions. The other style, which employs a short-stroke gas piston, involves a metal rod that pushes against the bolt carrier. The metal rod is driven by a piston, which typically is situated behind the barrel gas port.

There are a number of styles of AR rifles, which may include a detachable magazine, a pistol grip, as well as folding or collapsible stocks that reduce the overall length of the rifle. An example of a handguard mounting device for an AR style rifle is disclosed in U.S. Pat. No. 7,716,865 entitled, "Systems and Methods for Providing a Hand Guard and Accessory Mounting Device for a Firearm". The '865 patent discloses a handguard and a mountable accessory that connects to threads provided on the barrel. The '865 patent also discloses set screws used for securing the accessory along the barrel. U.S. Pat. No. 8,931,197 discloses a "Handguard for Firearm" with a barrel that is free-floating and is supported by the receiver assembly. The forearm is connected to the barrel or receiver assembly and is provided with rails for receiving accessories thereon. A conversion for a rifle, such as an AR-15, is disclosed in US 2012/0291329 for "Rimfire Action Platform Conversion" and discloses a handguard mount provided on the main stock for attaching a handguard thereto. US 2016/0209136, entitled, "Convertible Lower Receiver", provides a device for changing rounds, which is designed to allow a user to configure from one round to another by allowing switching from one upper receiver to another. U.S. Pat. No. 7,640,689 discloses a "Hand Guard System For Use With A Firearm" that comprises a first support or holding unit and a second support or holding unit, each of which removably couples to a firearm to support a handguard shell therebetween without having to remove or disassemble a barrel of the firearm to remove the holding units. The barrel may be used as a mounting surface to attach a base member. US 2010/0186278 discloses a "Handguard Assembly and Stanag Mount Adapter Assembly," with a securing mechanism for attaching a handguard to the barrel nut. US patent application 2019/0178608 A1 for a "Firearm Chassis With Integrated Rail System", discloses a chassis for a firearm that includes a lower receiver and a lower forend that are monolithically formed with one another.

US patent application 2013/0014418 A1 for a "Detachable Chassis Base For Rifle" discloses a lower chassis receiver assembly with a detachable chassis base that can be completely removable, or hingedly attached to provide access without completely removing the chassis base in order to handle different magazines and to permit removal of the chassis base for cleaning of the trigger mechanism. U.S. Pat. No. 10,443,963, discloses a "Modified Rifle Lower Receiver, Related Components, Cartridges, and Methods" that includes removing the standard lower receiver and firing pin from an upper receiver, installing a longer, modified firing pin into the upper receiver, and installing the modified lower receiver on the upper receiver.

US 2015/0184976 "Firearm Having a Removable Hand Guard" discloses a rifle having a receiver with a receiver frame, a barrel removably connected to the receiver frame, a cover coupled to the barrel and a removable handguard section extending over and surrounding the barrel. A "Firearm Accessory Mounting System" is disclosed in US2009/0056191 which has a handguard surrounding a portion of the barrel, and an upper shell and lower shell. A modular receiver system is disclosed in U.S. Pat. No. 7,313,883 comprising a barrel and receiver assembly providing a quick changeover coupling means for connecting the barrel to the receiver.

On rifles that have mating upper and lower receiver assemblies, there exists tolerance stack-up, or "slop" that will allow small movements between the two receivers when firing the rifle. These movements impact accuracy and precision, especially at extended ranges. Accuracy and precision are impacted due to angular projections of the movement between the receivers. Therefore, as the shooter attempts shots at longer ranges, the error from receiver movement is magnified.

Attempts to mitigate the tolerance slop however still have contact from the user on the upper receiver causing movement between the receivers. No matter what device is used between the receivers to mitigate tolerance stack-up, there will always be some movement allowed between the receivers due to every physical part having an associated tolerance. When the operator fires the rifle, his or her off-hand remains in contact with the handguard, grip, or other parts connected to the upper receiver that will force movement between receivers.

In addition to receiver tolerance differences, the traditional free float handguard can bend slightly based on material composition and length. If the sights or laser accessories are attached to that handguard, they will be subject to the movement from bending and decrease accuracy.

A need exists for a method and device that can provide versatility to the existing AR type rifles and improve accuracy.

SUMMARY OF THE INVENTION

Devices and methods for implementing a conversion of an automatic type rifle are provided. The devices and methods provide a chassis conversion for autoloading rifles with upper and lower receiver subassemblies.

A chassis conversion is provided for automatic type rifles, including AR-15, AR-10, and combat assault style rifles, such as special operations combat assault type rifles (also sold and/or referred to as SCAR-type rifles, and/or SCAR rifles when used by FN Herstal, S.A. for its brand of rifles), and CZ Bren rifles (CZUB). The chassis being implemented is similar to that of traditional bolt action platforms but is instead intended for AR-15 style rifles and similar variations including, but not limited to, the M16 and its sub-variations, the M4 and its sub-variations, the DPMS LR-308 and its sub-variations, the FN-SCAR, the Bushmaster ACR, the Smith & Wesson M&P 10, CZ Bren and the like. The design is also applicable to the SCAR pattern of rifles. The chassis conversion may be implemented for a variety of different caliber/chambering rifles.

The conversion device and methods provide a chassis style rifle configuration for automatic type or style rifles, including AR-15/AR-10/SCAR pattern rifles, comprising a conversion component that attaches to a standard or modified standard lower receiver while allowing the rifle to remain capable of being used as either a chassis gun or standard rifle configuration under different circumstances, as the operator desires.

The device eliminates the need for the operator to contact the upper receiver assembly during firing except to work firing controls when necessary (e.g., when the lower receiver component, such as a trigger or other firing control component, engages with an action component of the upper receiver). By eliminating the need to contact the upper receiver during the act of firing a shot, particularly for gripping with the off-hand or having a hand resting on separate shooting accessories, the rifle's accuracy and precision are enhanced. Accuracy and precision are enhanced by eliminating movement that would normally be caused by gripping the forearm of the rifle causing movement between the upper receiver and lower receiver assemblies or flexion of the handguard.

According to some embodiments, the devices may be adapted and configured to convert mostly any AR-15/AR-10/SCAR style derivation or rifle that uses separated lower and upper receiver assemblies by providing a lower receiver extension to form a rifle forearm.

The devices and methods provide the AR/SCAR styles of rifles with a configurable and deconfigurable capability of achieving a form similar to that of a bolt action rifle but with auto-loading rates of fire and common AR parts. The present method for converting the automatic type rifles involves configuring the rifle with one or more conversion parts, referred to in some embodiments herein as a mount piece. The conversion devices are fitted to the automatic rifle, such as an AR style rifle. The devices may comprise a mount piece that connects to the rifle. The mount piece may comprise a plurality of elements that enable connection of the mount piece to the rifle, and more preferably, the magazine well or other portions of the lower receiver of the rifle. The present devices and methods minimize, and more preferably eliminate the need to handle the upper receiver or components attached to the upper receiver, allowing for improved accuracy.

The seam of an AR style rifle (or other style rifle having a receiver assembly that is comprised of an upper receiver and lower receiver) where the upper and lower receivers meet generally provides an area where machining tolerance stack-up, or "slop", is present and allows small movements between the two mating parts. When a user touches any parts connected to the upper receiver (barrel, handguard, etc.), the user is causing small movements of the upper receiver relative to the lower. In the case of rifles equipped with free float handguards, the pressure on the handguard by the user causes flexion of the handguard creating similar small movements. The small movements accentuate reduction of accuracy, especially when firing from long ranges. The present invention provides an AR chassis conversion, which according to preferred embodiments, is constructed to completely free float the entire upper receiver of an AR to the lower receiver. The embodiments eliminate the need to touch any part of the upper receiver or the upper's mating parts when firing the rifle. In other words, even when using a free-float style handguard, there is still a point of contact with the upper receiver when gripping and firing the firearm. The present configuration of the conversion design eliminates that point of contact with the upper receiver by extending the reach of the lower receiver with a forearm originating solely from the lower receiver subassembly. According to preferred embodiments, the conversion may be accomplished with a mount piece that connects to the lower receiver. The mount piece or a component attached to the mount piece, such as a forearm piece, may be integrated as part of the mount piece, or alternatively, may be connectable to the mount piece and released or disconnected therefrom. The detachment of the component, such as a forearm piece, from the mount piece enables the return to the rifle configuration where the mount piece is still connected to the lower receiver. In this configuration, the mount piece may serve to attach and support one or more other components, such as accessories, or a different forearm piece or handguard.

The invention permits ready change of components, such as accessories, to the mount piece. The configuration of the mount piece holds the accessories to the lower receiver, and does not rely on the upper receiver to support the accessories or the mount piece, thereby eliminating user contact with the upper receiver or accessories connected thereto.

According to preferred embodiments, the conversion device is configured to comprise a mount piece that is securable to the magazine-well or other portions of the lower receiver. According to some preferred embodiments, the securable mount piece may extend a new forearm for gripping which may be disposed outward, parallel to the barrel.

According to a preferred implementation, the method for converting the rifle involves the removal of the original handguard to allow the new conversion chassis handguard to remain close to the barrel much like a standard handguard. Then a cover for the gas tube or gas piston assembly is affixed to the upper receiver to protect those parts without the original handguard in place to do so. The cover may incorporate picatinny rail sections to facilitate accessory mounting.

According to preferred embodiments, the conversion chassis is comprised of a mount piece and, preferably also includes a forearm piece. The mount piece attaches to the lower receiver. According to some embodiments, the mount piece may be mounted to the magazine-well. The mount piece provides a mounting structure to which accessories or other mounting components may be attached. According to some preferred embodiments, the mount piece provides a forward extension that is located after the magazine well. The mount piece may be configured to comprise a plurality of portions.

According to some preferred embodiments, the conversion chassis is comprised of a mount piece and forearm piece. According to some embodiments, the mount piece may be comprised of a series of parts that conform to the magazine-well or other portions of the lower receiver. According to some preferred configurations, the mount piece may extend a mounting surface onto the front of the magazine-well when joined together or installed on the magazine well. The surfaces formed by the mount piece subassembly are then used to fasten (e.g., screw or clip) the forearm piece subassembly in place to form the entire conversion chassis assembly.

The present devices and configuration allow the entire upper receiver assembly to remain free floated with respect to the entire lower receiver assembly. For example, accessories such as a bipod (or other accessory) may be mounted to the forearm piece and, as a result of the present conversion configuration and mount, will not apply pressure to the upper receiver in any way. The top cover for the gas tube or gas piston can be affixed to the barrel nut, upper receiver, barrel, gas block, or front sight base to provide a steady base for accessory mounting without touching the forearm piece and compromising accuracy.

The present method and devices provide improved accuracy from the automatic rifle platforms, such as, for example, the AR-15/AR-10/SCAR type platforms, and mimics the accuracy of precision bolt-action rifles. The AR-style of rifle is already an accurate platform, but it is subject to the same tolerance issues present in any machine. The present conversion devices and methods mitigate the issues present in the rifle to provide a more accurate, precise, and stable shooting system. The conversion chassis also prevents the need for permanent modifications to be made to the rifle. The system further allows rapid fire of a chassis-based rifle system compared to the rate of fire achievable with a bolt-action rifle. For example, the invention also provides shooters with the ability to quickly transform and reconfigure a carbine or similar style rifle into a precision platform with the ability to quickly reverse the changes at will. The conversion system also allows for a user to have a more traditional style of forearm, if the user prefers. Finally, the conversion system allows users with minimal rifle building skills the ability to install and maintain the conversion by using an automatic rifle, such as the AR-15/AR-10/SCAR, as the base rifle.

Embodiments of the method and devices provide a lower receiver mounting method with a separate, detachable forearm subassembly. The devices and methods of the invention prevent the necessity for any permanent changes to the lower receiver for practicality, reliability, as well as in some instances for legal purposes. From a practicality standpoint, allowing removal minimizes the impact the chassis conversion system has on impeding the natural pivoting motion of the upper receiver during firearm disassembly. For practicality, a nonpermanent option also provides the user the ability to maintain one lower receiver that can provide the benefits of a chassis rifle under some circumstances and a normal rifle configuration under other circumstances. In other words, it allows easy removal to revert back to a non-converted lower receiver at the user's will which makes the same lower receiver serve a variety of roles. The same lower receiver serving as a chassis gun or a standard rifle configuration under different circumstances also allows the serialized part of the firearm to be used in a variety of roles. Therefore, only one serialized part needs to be controlled versus having a dedicated chassis gun and dedicated standard rifle. The ability to meet lawful compliance and provide versatility is accomplished with the invention. Also, the ability to separate the forearm from the mount subassembly allows a variety of different forearm pieces (varying in length, height, width, material, etc.) to be installed onto the same mount subassembly. The ability to install a variety of different forearm pieces allows the user to tailor a forearm piece to his or her individual needs. Additionally, the mount subassembly can then be made for a specific firearm model and a multitude of forearm piece options will mate with the clamp or mount portion.

It is important to mention that the non-permanent mount assembly is only necessary to avoid permanent modification to a standard AR pattern or SCAR pattern lower receiver. And while the non-permanent solution provides the many benefits such as those listed above and is preferable, this invention, in one or more alternate embodiments, is also applicable to lower receivers that are permanently modified to provide a mount for the forearm. The forearm mounting point can be welded, forged, or provided from virtually any manufacturing process. In which case, the lower receiver after modification would become the new "standard" lower receiver as long as the role of being useable in the non-chassis configuration is still possible. This invention of a chassis conversion is to provide the user with a single lower receiver that can be used as a standard (aka traditional) rifle setup or as a chassis gun at will. It does not make the lower receiver strictly a chassis gun regardless of lower receiver modification. This invention is a conversion, not a monolithic AR pattern receiver.

The chassis conversion methods and devices for the AR style rifle is designed to eliminate the need to grip/mount accessories from any parts touching the upper receiver due to the accuracy error imparted from tolerance slop between the upper and lower receivers or traditional free float handguard flexion. The invention enhances the accuracy of the AR-style rifle in many calibers and configurations. This style of rifle is already an accurate platform, but it is subject to the same tolerance issues present in any machine. This invention mitigates the issues present in the rifle to provide a more accurate, precise, and stable shooting system. Additionally, this invention being a chassis style forearm allows the shooter to have a rifle that resembles a bolt action rifle but with the common parts, availability, and rapid rate of fire of the AR family of rifles. The invention also provides shooters with the ability to quickly transform and reconfigure a carbine or similar style rifle into a precision platform with the ability to quickly reverse the changes at will. Finally, the conversion system provides a more traditional style forearm for shooters who prefer such a component.

By providing a forearm attached to the lower receiver and not contacting the upper receiver, a degree of freedom is removed from the system (the rifle). The forearm allows the operator to only touch parts of the lower receiver assembly when shooting. Contacting the upper receiver is now only necessary to work other controls (charging, sight adjustments, scope adjustments, clearing malfunctions, etc.).

While the two receivers are still free to move relative to each other due to tolerance stack-up, they will be free of additional movement caused by operator contact on the upper receiver. The two receivers have a tendency to settle back into what shall be referred to in this document as a "home position." The home position is where the two assemblies settle back into after a shot from the rifle as long as there is no interference from the operator. This chassis style conversion eliminates the additional interference thereby allowing the rifle receiver assemblies to settle back into the home position to increase accuracy and precision.

These and other advantages may be provided by the devices and methods. Features disclosed in connection with one embodiment may be employed in other embodiments and/or may be combined together with one or more features of other embodiments.

BRIEF DESCRIPTION OF THE DRAWING FIGURES

FIG. 3 is a schematic depiction of a series of images of the rifle shown in FIG. 1, illustrating an exemplary implementation of a conversion of the rifle according to the present method and using an exemplary conversion component.

FIG. 22 is a perspective view, looking from above at the right side, of an alternate embodiment of a conversion device according to the invention, showing a lower receiver configured with a mounting feature to connect with accessories.

FIG. 23 is an exemplary accessory shown comprising a forearm configured for mounting to the lower receiver of FIG. 22.

FIG. 24 is another perspective view of the lower receiver of FIG. 22 shown from a different angle.

FIG. 25 is another perspective view of the forearm piece of FIG. 23 shown from a different angle.

FIG. 26 is an exploded assembly view in perspective showing the lower receiver of FIGS. 22 and 24 connecting with the forearm piece of FIGS. 23 and 25.

DETAILED DESCRIPTION OF THE PREFERRED EMBODIMENTS

Figure 1:
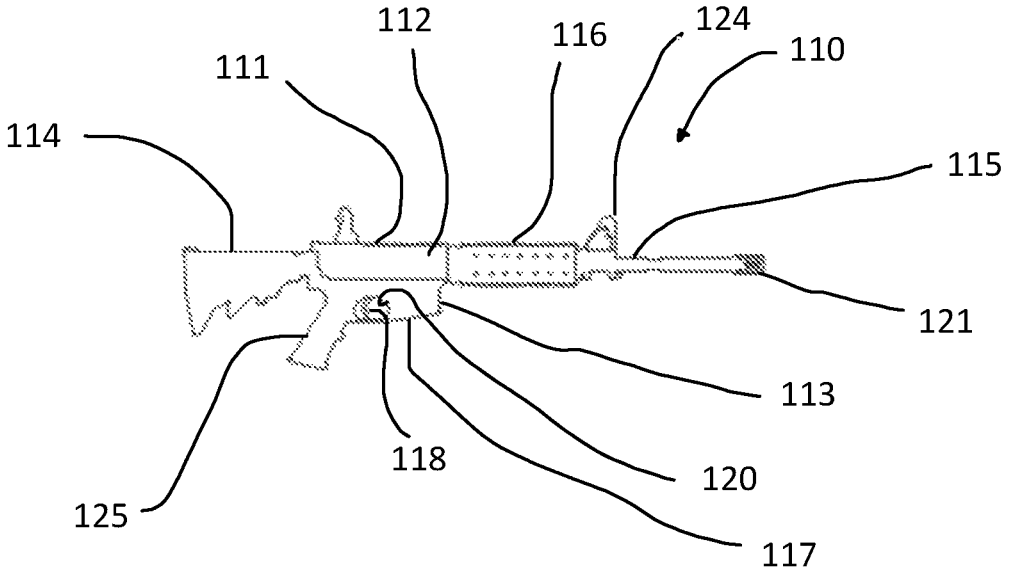
(Prior Art) Fig. 1
FIG. 1 is a right side elevation view of an exemplary embodiment of a typical AR style rifle.

Referring to the drawing figures, the present invention is used in conjunction with a firearm, such as a rifle, and more particularly, to military or tactical style rifles, such as, for example, an AR-15, AR-10, SCAR, M-16, M-4, etc., and the like. For example, the devices of the invention may be applied to convert rifles, such as automatic type rifles, AR-10, AR-15, and SCAR type rifles. The present method implements conversion of an automatic type rifle, such as an AR-10, AR-15, SCAR or other rifle, to provide a chassis style rifle configuration for AR-15/AR-10/SCAR pattern rifles by attaching a conversion component to a standard or modified standard lower receiver while remaining capable of being used as either a chassis gun or standard rifle configuration under different circumstances, as desired by the user. This device configuration eliminates the need for the operator to contact the upper receiver assembly during firing except to work firing controls when necessary (to translate the actuation to an action component). By eliminating the need to contact the upper receiver during the act of firing a shot, particularly for gripping with the off-hand or resting on separate shooting accessories, the rifle's accuracy and precision are enhanced. Accuracy and precision are enhanced by eliminating movement that would normally be caused by gripping the forearm of the rifle causing movement between the upper receiver and lower receiver assemblies or flexion of the handguard. The conversion devices may be employed to convert an AR-15/AR-10/SCAR derivation or rifle that uses separated lower and upper receiver assemblies by using the same principle of providing a lower receiver extension to form a rifle forearm.

According to some embodiments, the mount portion may mount the forearm to the rifle. The mount portion may provide a foundation for the attachment of the forearm (which may be one of a variety of user selected forearms), and/or other accessories. According to some alternate embodiments, the mount, such as a forearm mount, may be a permanent addition (integrally provided) to the lower receiver allowing for attachments and removal of accessories, such as the forearm or handguard, so that only the lower receiver is contacted (aside from an action component engagement by the trigger when firing). The mount portion may be comprised of a clamp around the lower receiver or portion thereof. According to some other embodiments, the mount portion may be comprised of a tap or hole pattern integral to the lower receiver. The mount may be attached to the lower receiver based on operator preference, and according to preferred embodiments, may be removed therefrom. The mount portion can extend beyond the magazine-well to be joined to other portions of the lower receiver such as the trigger guard, grip, buffer tube, etc. The mount portion preferably provides a sole foundation for attaching a forearm to the firearm originating from the lower receiver instead of the upper receiver. The mount subassembly consists of a series of parts that grasp various areas of the rifle's lower receiver including but not limited to the magazine well and trigger guard. The mount subassembly has recesses that conform to the lower receiver to "cup" the lower receiver. Then the mount provides a portion of material that allows the forearm subassembly to be joined to it. According to some embodiments, the mount subassembly may extend beyond the magazine-well to be joined to other portions of the lower receiver such as the trigger guard, grip, buffer tube, etc. The attachment points between mount subassembly and lower receiver subassembly are dependent on operator preference and specific lower receiver geometry. The user may implement the conversion of a rifle when desiring to convert the rifle to receive and accept accessories on the lower receiver only, so as to prevent engagement of the accessories with parts of the rifle (i.e., the upper receiver).

Referring to FIG. 1, a typical rifle 110 of the prior art AR style is depicted. The firearm or rifle 110 generally includes a receiver assembly 111, comprising an upper receiver 112 and lower receiver 113. The rifle 110 is fitted with a buttstock 114 connected to the rear of the receiver assembly 111. In the exemplary depiction of the rifle 110, a barrel 115 is shown connected to the front of the receiver assembly 111. The rifle 110 includes a forearm or forestock 116 (which may alternately be referred to as a "handguard" in the art). In the embodiment depicted, the forestock is shown depicted as a gas tube having apertures therein for venting gasses. The receiver assembly 111 typically houses the firing mechanism as well as some of the other components, e.g., such as a bolt and a charging handle. Typically, the barrel 115 and the bolt are located within or supported on the upper receiver 112, and the firing mechanism and magazine are typically carried by the lower receiver 113. As illustrated, a magazine well 117 is shown disposed within the lower receiver 113, and a trigger 118 is shown disposed within the trigger guard 120. In the rifle arrangement illustrated, the barrel 115 in the depicted exemplary embodiment is shown configured to connect to the receiver assembly 111 and is supported by the connection to the receiver assembly 111, and is typically supported by the upper receiver 112. In the embodiment illustrated, a muzzle 121 is shown provided at the tip of the barrel 115. The forearm 116 is shown connected to the barrel 115 and/or receiver assembly 111, and in the exemplary depiction is shown covering a portion of the length of the barrel 115. The forearm 116 is shown connected at the receiver assembly 111, and may for example, in the typical AR style rifle use a threaded connection with threading inside the forearm 116 to connect to a matingly threaded connector of the receiver 111. Alternatively, AR style rifles may be provided where the forearm 116 does not completely cover the barrel 115, and, for example, may cover or be positioned adjacent one or more sides of the barrel 115. A magazine holder for holding a magazine also may be provided, and the magazine may be inserted into the magazine well 117 where it is received to provide a supply of ammunition to the bolt and firing mechanism (see the magazine 401 in FIG. 5A). The firearm 110 may also include other known components, such as sights, such as the exemplary sight 124, a handgrip 125, and/or other components. It is understood that the firearm 110 may not include one or more of such components in other embodiments.

The devices and methods of the invention may be utilized in conjunction with a firearm, such as the rifle 110 depicted in FIG. 1, as well as other AR and/or SCAR type rifles.

Figure 2A:
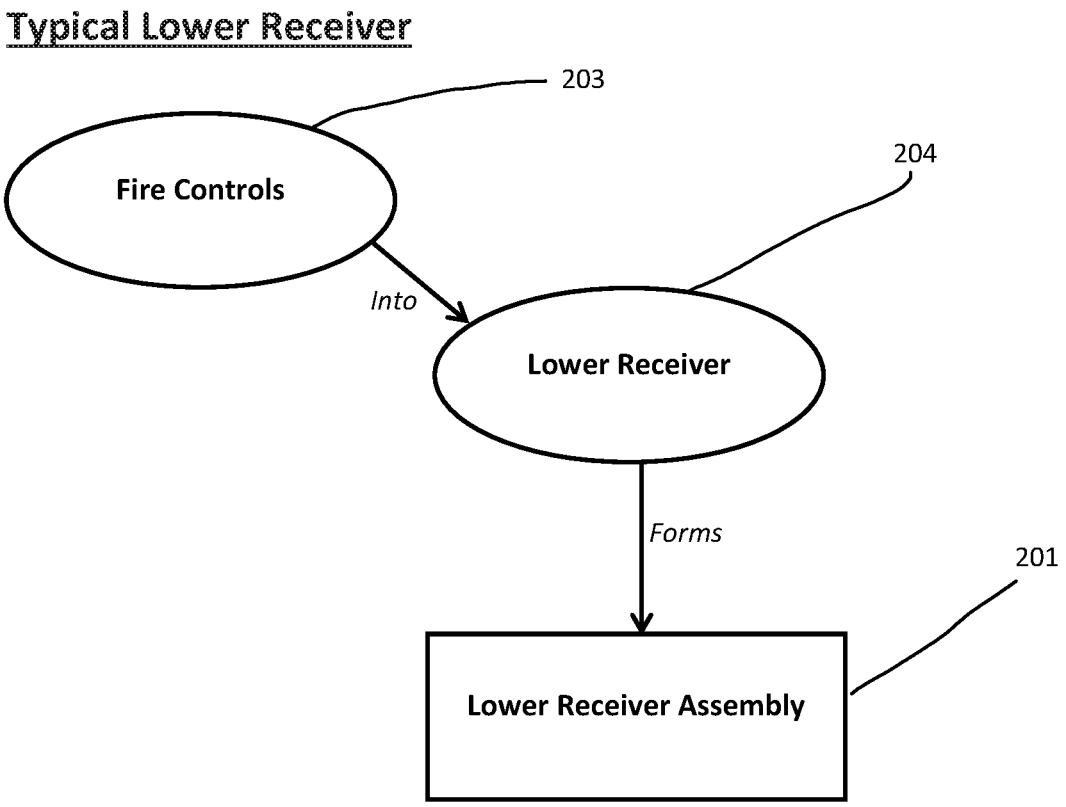
(Prior art) Fig. 2A
FIG. 2A is a schematic depiction of a prior art assembly for a lower receiver assembly of a rifle, such as a two-piece or AR style rifle.
Figure 2B:
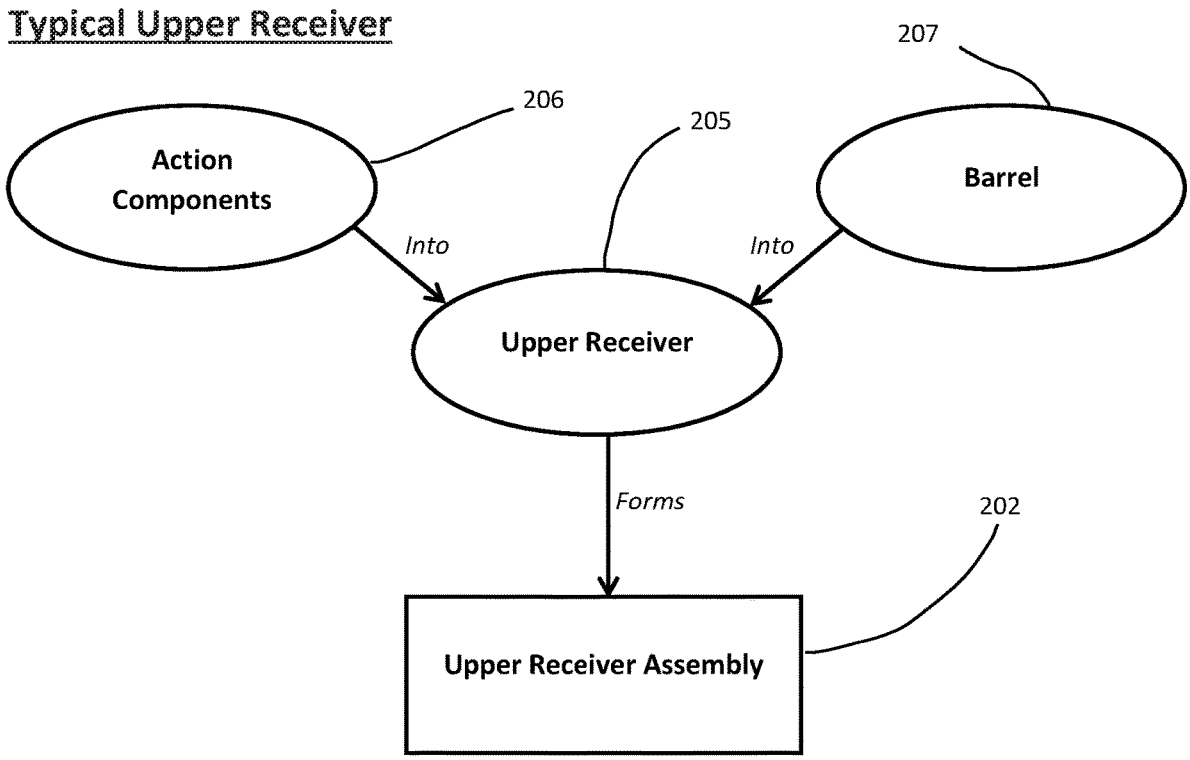
(Prior art) Fig. 2B
FIG. 2B is a schematic depiction of a prior art assembly for an upper receiver assembly of a rifle, such as a two-piece or AR style rifle.

Referring to FIGS. 2A and 2B, schematics depicting a typical lower receiver assembly 201 (FIG. 2A) and upper receiver assembly 202 (FIG. 2B) are shown. The assemblies in FIGS. 2A and 2B are typically for a two-piece style rifle, such as the AR style rifle where a lower receiver and an upper receiver are joined to form the rifle. The fire controls 203 are formed into the lower receiver 204 to form the lower receiver assembly 201. The upper receiver 205 houses the action components 206 and joins the barrel 207 to form the upper receiver assembly 202. The upper receiver assembly 202 and lower receiver assembly 201 are joined to form the rifle.

Figure 2C:
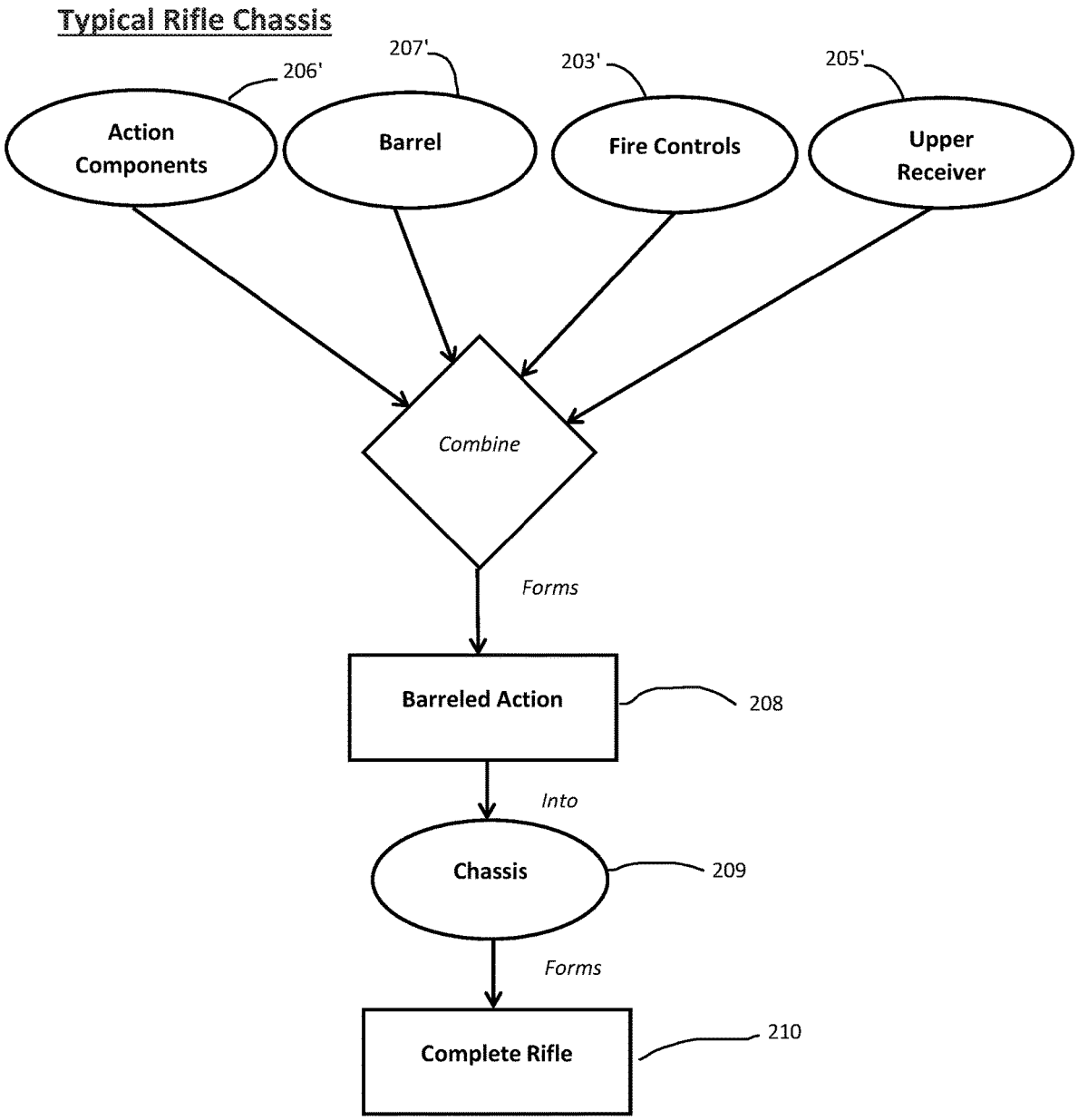
(Prior art) Fig. 2C
FIG. 2C is a schematic depiction of a prior art assembly for a chassis style of a rifle.

FIG. 2C depicts a schematic of a standard type rifle chassis, also known as a chassis style rifle or bolt action type rifle, where the components form a rifle 210. The exemplary depiction of the formation of the rifle 210, as schematically shown, combines the action components 206', the barrel 207', the fire controls 203' and upper receiver 205', which are assembled together into a barreled action 208. The barreled action 208 is joined to chassis 209 to form a complete rifle 210.

Referring to FIG. 3, a schematic depiction of a device and method for converting an automatic type rifle, such as for example, an AR style rifle, is illustrated. A three-step process is depicted for attaching and detaching a conversion component, such as a mount piece, to the lower receiver of a rifle. In FIG. 3, a standard automatic style rifle, represented by the automatic rifle 110 (similar to the automatic rifle 110 depicted in FIG. 1 and described herein) is shown configured as an AR style rifle. The rifle 110 is depicted as the host rifle for conversion. In the upper image, the host rifle's lower receiver assembly 113*a* remains free of the conversion components. This represents a standard rifle configuration for AR type pattern rifles. The conversion may be implemented when a user desires chassis-like performance, whereupon the user converts the standard rifle 110 to the conversion embodiment rifle 110' shown in the middle image of FIG. 3. The conversion component or components of the device, represented generally by the lower mount piece 220 is shown installed on the rifle 110, fitted to the lower receiver assembly 113, to produce the conversion rifle 110' (middle image of FIG. 3). When the user desires to change the mount piece to a different mount piece, or for example, to change a mount piece component or portion, such as the mount piece 220, the user may then convert the rifle back to the original standard form 110 shown in the lower image of the image series of FIG. 3 (which is also the first image—prior to conversion). Alternatively, where the mount piece is provided in a plurality of sections or components, for example, where a first mount piece is configured to mount to the lower receiver, and also is configured to connect with one or more removable second mount pieces, then the conversion back to a standard rifle may be fully converted back, by removing the first mount piece of the plurality of mount pieces, as well as the second or other mount pieces connected thereto, or alternatively, by removing only the second or other mount pieces and leaving installed on the lower assembly, the first mount piece so that the second or additional mount pieces (or accessories, such as a handguard/forearm) may be added to the first mount piece that is permitted to remain installed on the rifle (preferably connected to the lower receiver).

The mount piece 220 shown in FIG. 3, may be configured to accommodate different host rifle lower receiver assembly geometries. For example, the mount piece may be configured to have a mating profile that is matingly associated with the profile or geometry of the rifle lower receiver to be converted. The mating profile or geometry of the mount may be configured for association with one or more surfaces or other structures of the lower receiver. For example, a particular rifle manufacturer may provide a lower receiver geometry in a rifle that differs from the other lower receiver geometries of other rifles on the market (for performance, aesthetics, etc.), or that have been marketed previously. The present system provides a mount that is designed to attach to the particular lower receiver of the rifle to be converted. In some instances, the mount piece may be configured to fit more than one manufacturers lower receiver.

According to some alternate embodiments, the mount may be provided as part of the lower receiver. Differences in the mount piece configuration may be required to accommodate lower receivers, such as for example, AR-15s, AR-10s, SCARs styles of rifles, and, according to some implementations, mount piece configurations for installation to other manufacturer's specific lower receivers and their specific configurations, may require extending one or more portions of the present device conversion components, such as the mount piece or mount pieces, for attachment to one or more other areas of the lower receiver assembly (e.g., such as the stock, buffer tube, grip, and the like). The present device and method provide for ready attachment to and detachment from the host rifle to be converted. The conversion components, such as the mount piece or mount pieces, only contact with the lower receiver assembly. In other words, according to preferred embodiments, the mount piece or pieces, only engage with the lower receiver, and do not contact or engage with the upper receiver or barrel (or preferably, any of the rifle portions other than the lower receiver.

Figure 4A:
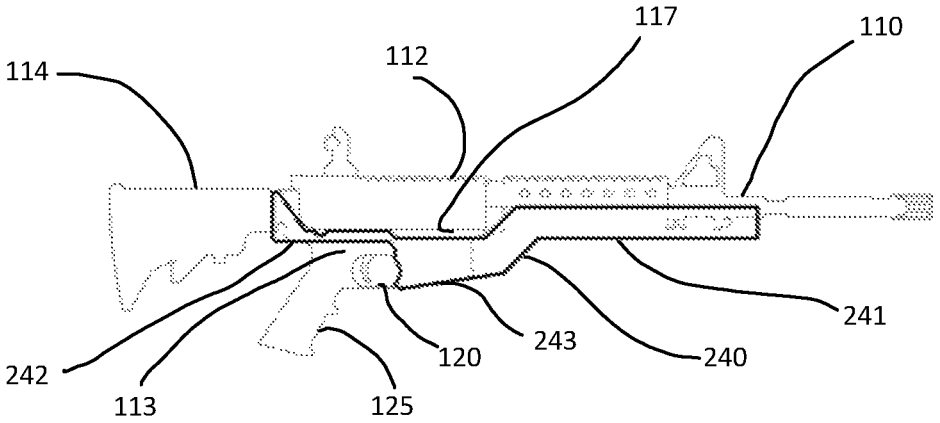
FIG. 4A is a right side elevation view of the exemplary embodiment of the rifle shown in FIG. 1, depicted with a first embodiment of a conversion feature installed.
Figure 4B:
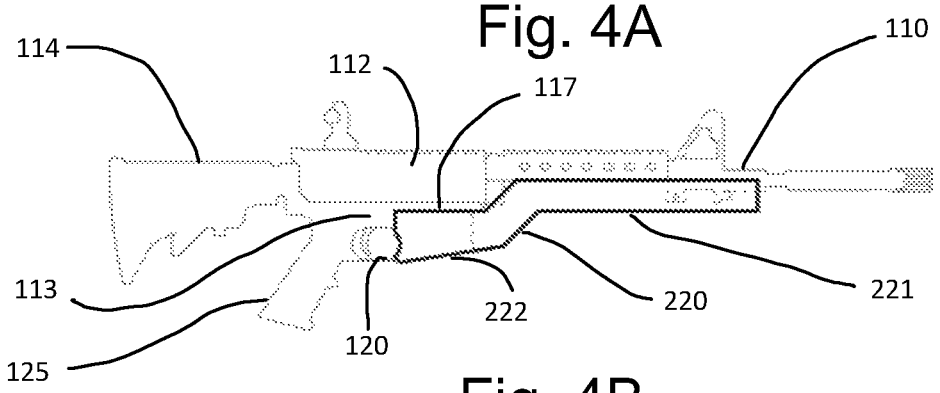
FIG. 4B is a right side elevation view of the exemplary embodiment of the rifle shown in FIG. 1, depicted with a second embodiment of a conversion feature installed.
Figure 4C:
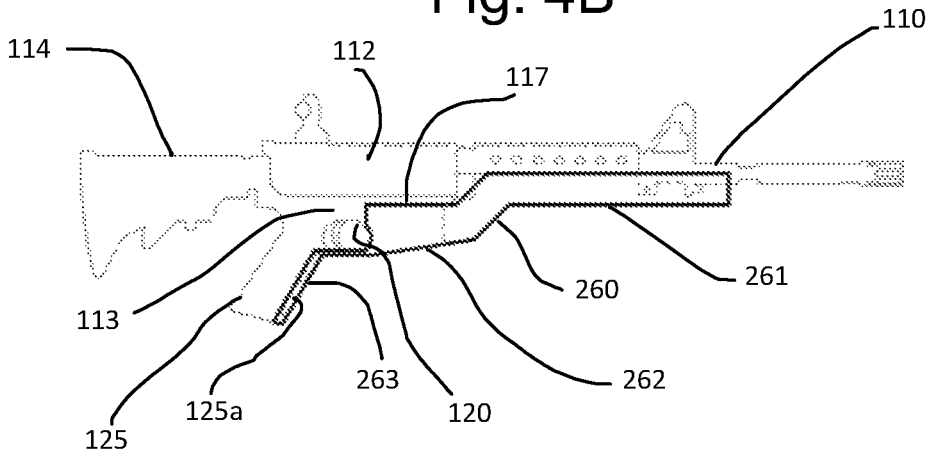
FIG. 4C is a right side elevation view of the exemplary embodiment of the rifle shown in FIG. 1, depicted with a third embodiment of a conversion feature installed.

Referring to FIGS. 4A, 4B and 4C, depictions of the rifle 110 (shown in FIG. 3), are again shown, but with alternate mount piece assemblies. For example, FIG. 4A illustrates the rifle 110 with a mount piece 240, shown fitted on the lower receiver 113, and also including a forearm piece 241, and a rear portion 242 that is disposed above the trigger guard 120, and along the lower receiver 113 toward the buttstock 114. The mounting portion 243 is shown fitted on the magazine well 117. FIG. 4B depicts a mount piece 220 which includes a forearm piece 221 and a mounting portion 222 disposed on the magazine well 117 (covered in the view). FIG. 4C illustrates another alternate embodiment of a mount piece 260 shown mounted to the lower receiver 113, where the mount 260 is configured along the profile of the bottom of the trigger guard 120, and the front portion of the handgrip 125. The mount rear portion 263 may have a profile that mates with the surface of the handgrip 125, such as for example, the handgrip front portion 125*a*, and, according to some embodiments, the mount rear portion 263 may be configured to serve as the front of the handgrip, and optionally may have a profile that is configured as a handgrip profile. The mount 260 is shown with a mounting portion 262 attached to the lower receiver 113, and fitted on the magazine well 117 (covered by the mount 260). In each of the depictions in FIGS. 4A, 4B and 4C, each respective mount piece 240, 220, 260 is connected to the lower receiver (e.g., 113) and remains free from contact with the upper receiver 112.

Figure 5A:
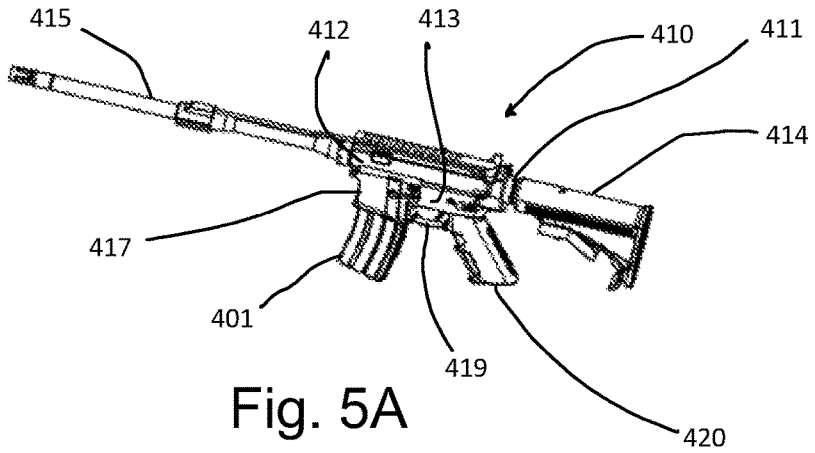
FIG. 5A is a perspective view of an exemplary embodiment of an AR style rifle shown with a magazine installed in the magazine holder.
Figure 5B:
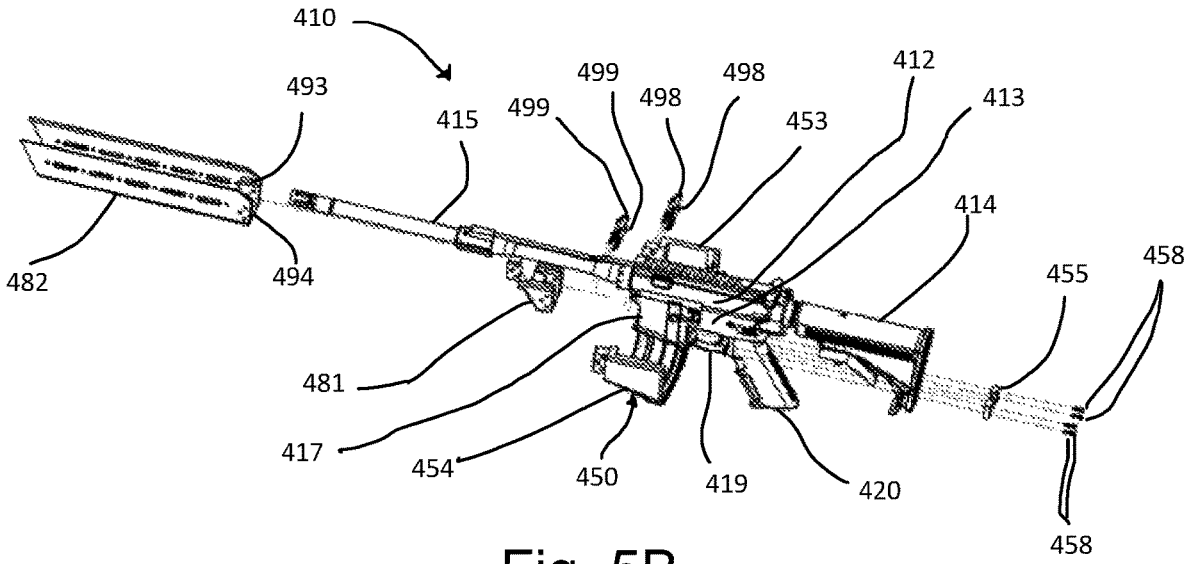
FIG. 5B is a perspective view of the rifle shown in FIG. 5A, illustrated with the conversion device and accessory shown in exploded view.

The devices and methods may be implemented in accordance with the above embodiments, and the embodiments depicted in FIGS. 3, 4A-4C, 5B-5G, 6-17. Referring to FIG. 5A, a standard automatic AR type rifle 410 is shown comprising an upper receiver 412, a lower receiver 413 forming a receiver assembly 411, a buttstock 414 connected to the rear of the receiver assembly 411, and a barrel 415 connected to the front of the receiver assembly 411. The rifle 410 is shown having a magazine well 417 fitted with a magazine cartridge 401 therein. The rifle 410 includes a trigger guard 419 and a handgrip 420. An exemplary embodiment of a present conversion device 450 is shown in FIG. 5B in an exploded assembly view. FIG. 5B depicts an exemplary embodiment of a conversion component comprising a mount piece 451. The mount piece 451 is shown in an exploded assembly view in FIG. 5B and is shown assembled and installed on the rifle 410 in FIG. 5C. FIG. 5D shows the exploded view of the mount piece 451 in a top perspective view of the rifle 410 with the mount body portions 453, 454 shown detached on each side of the rifle magazine well 417. The mount piece 451 is shown comprising a mount body. The mount body, in accordance with an exemplary embodiment, is configured having a plurality of components, and, in the exemplary embodiment depicted, has a first mount body portion 453 and a second mount body portion 454. The mount body portions 453, 454 connect to the lower receiver 413. The mount body portions 453, 454 are shown on opposite sides of the magazine well 417. As illustrated, the mount body 451 is secured to the lower receiver 413, and in the embodiment represented, is installed at the magazine well 417. A joining piece 455 is provided to connect the first and second mount body portions 453, 454. Fastening means such as the screws 458 are shown connecting the joining piece 455 to the mount body portions 453, 454.

Figure 7:
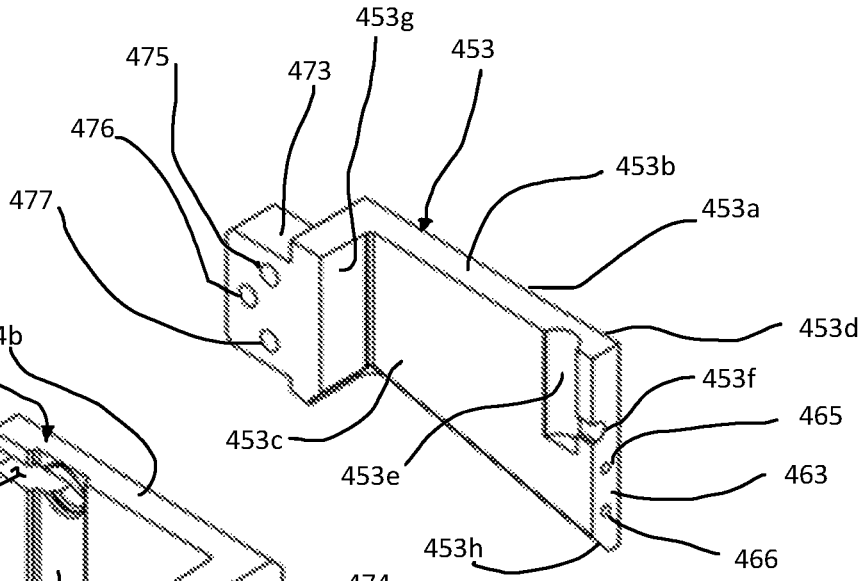
FIG. 7 is a rear perspective view of an exemplary embodiment of a mount piece, shown separate from the other components.
Figure 9:
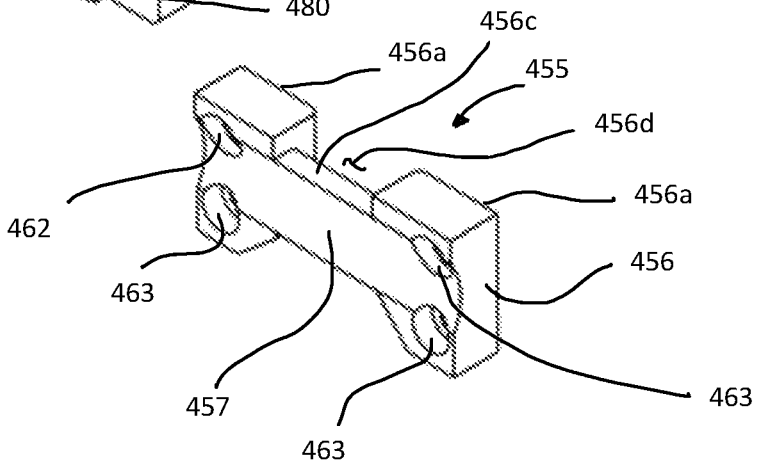
FIG. 9 is perspective view of a connector plate, shown separate from the other components.

According to some embodiments, the mount piece 451 comprises or is configured as a first mount piece, and may remain attached to the lower receiver, such as the lower receiver 413 of the rifle 410 shown herein for illustration purposes, so that accessories or other components may be attached to the mount piece 451. The mount piece 451 is shown having a connecting portion 472 comprising connecting flanges 473, 474 that are inwardly disposed to connect with each other at the front of the magazine well 417 (see FIG. 5B). According to preferred embodiments, the front connecting flanges 473, 474 engage each other to provide a point of connection for a second mount piece, such as a forearm, handguard or other accessory. As illustrated in FIGS. 7 and 9, a connection is shown provided in the front connecting flanges 473, 474, comprising a plurality of apertures 475, 476, 477 on the first mount body portion 453, and a plurality of apertures 478, 479, 480 on the second mount body portion 454. The apertures 475, 476, 477 and apertures 478, 479, 480 preferably align with each other. The apertures may comprise threaded bores for receipt of matingly threaded screws, or alternatively, for example, screws and mating bushings may be provided to connect through the apertures, e.g., such as matingly threaded bushings or posts. The mount piece 451 supports detachably connectable accessories thereon. One example of a detachable accessory is a handguard. A variety of handguards, as desired for use by a user, may be installed on and removed from the conversion component, such as the mount piece 451.

For example, a forearm portion may be reconfigured to suit a variety of user preferences. The forearm portion may be of a variety of sizes or shapes based on operator preference. The forearm may be constructed to partially or fully enclose the gas tube if the operator desires, or a separate gas tube cover may be employed. According to some preferred embodiments, the forearm portion, such as for example, a handguard, may solely provide the gripping surface and extend from the lower receiver mount, such as the removably connectable mount piece (shown installed on the lower receiver).

According to a preferred embodiment, to illustrate the capabilities of the device, the mount piece 451 is shown assembled in a configuration connected to a second mount piece 481. The second mount piece 481 is shown supporting a forearm piece or handguard 482, although the second mount piece 481 or other second mount pieces may connect with the mount piece 451 to removably mount the handguard and/or other accessories that may be used with the rifle, such as scopes, bipods, magazine holders, and the like. The second mount piece 481 is shown having a mounting portion 483 comprised of proximal flanges 484, 485 that are situated to engage the front flanges or connecting flanges 473, 474 of the mount piece 451 (see FIGS. 10-13). In the embodiment illustrated the respective flanges 473, 474 are those of the respective mount piece body portions 453, 454. According to preferred embodiments the second mount piece 481 preferably is configured to make a releasable connection with the first mount piece 451 so that the second mount 481 piece may be connected to and detached from the rifle 410 via its releasable connection to the first mount piece 451. The second mount piece 481 may be connected separately or together with one or more of the first mount piece 451 and/or accessories, so that the accessory (or accessories) attached thereto (such as the handguard 482) may be removable or connected to the mount piece 451 with the second mount piece 481 already connected or remaining connected.

Figure 5C:
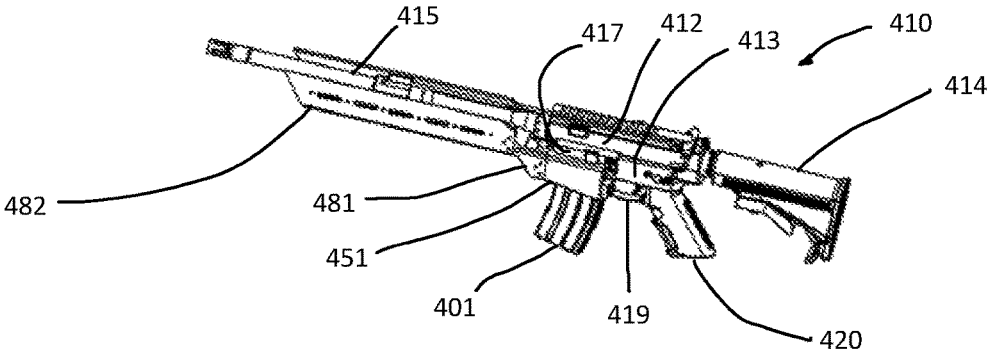
FIG. 5C is a perspective view of the rifle shown in FIG. 5B, shown with the conversion device and accessory installed on the rifle.
Figure 5D:
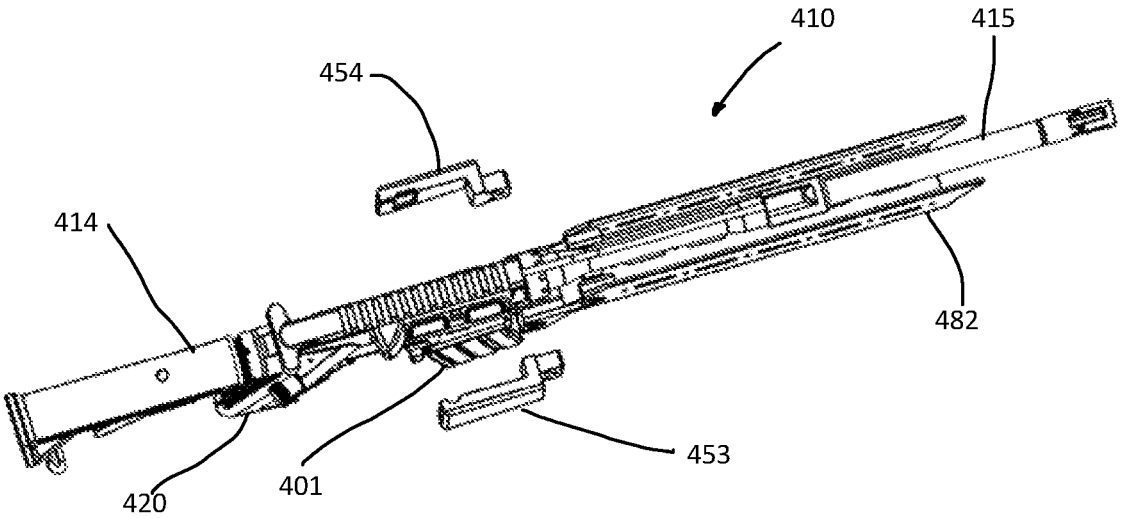
FIG. 5D is a perspective view of the rifle shown in FIG. 5B, as viewed from the top, showing conversion device components detached from the rifle.
Figure 5E:
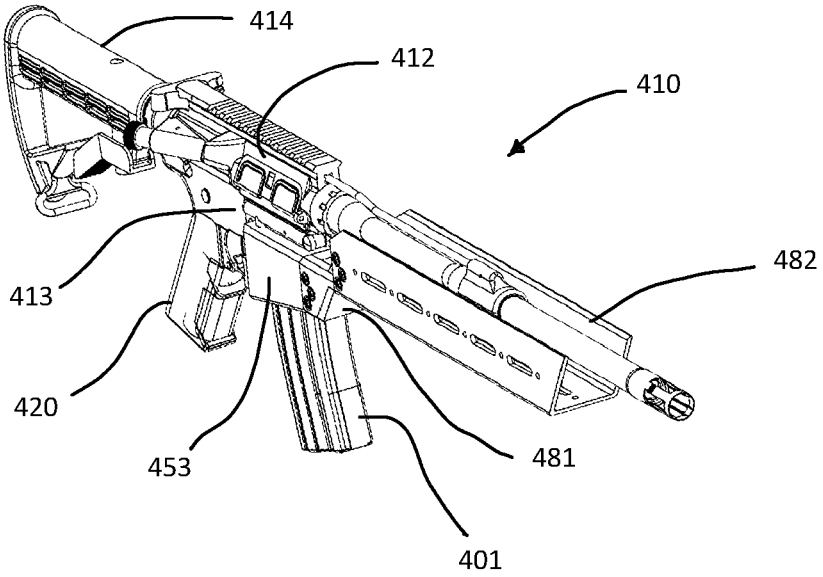
FIG. 5E is a perspective view of the rifle shown in FIG. 5C, as viewed looking from the front looking from above.
Figure 5F:
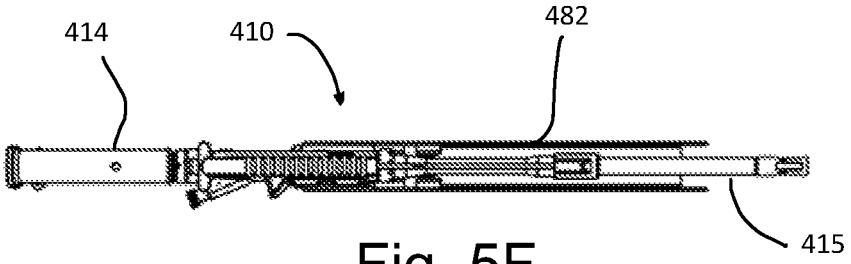
FIG. 5F is a top plan view of the rifle shown in FIG. 5C.
Figure 5G:
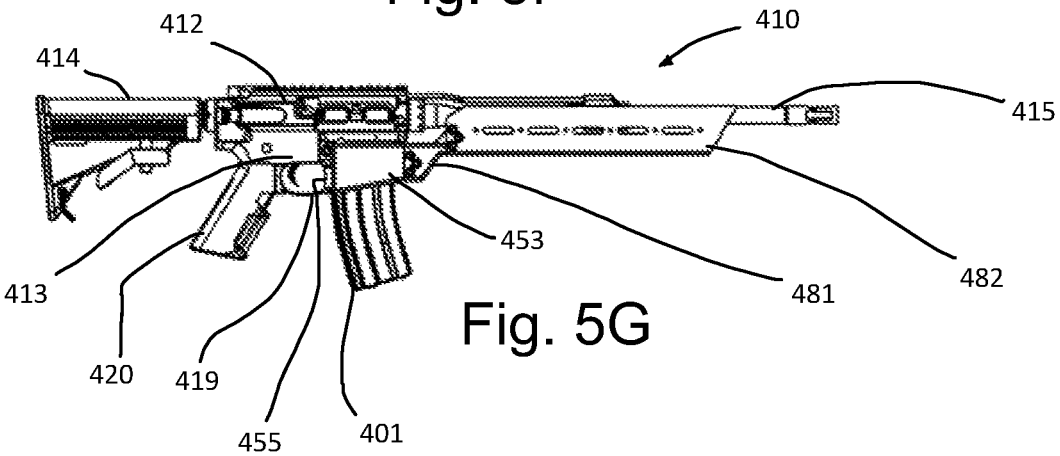
FIG. 5G is a right side elevation view of the rifle shown in FIG. 5C.

In the depiction of FIGS. 5C and 5E, the mount-forearm assembly (comprising the mount pieces 451, 481 and forearm 482) affixed to a rifle lower receiver 413 with an upper receiver 412 installed. The illustration in FIGS. 5C and 5E demonstrates that the rifle 410 can be gripped without touching the upper receiver 412 through the use of the lower-receiver-mounted forearm 482. FIGS. 5E, 5F and 5G illustrate different views of the rifle 410 shown in FIGS.

5A-5D shown with the mount piece 451 installed, and with the handguard accessory 481 connected to the rifle 410.

Figure 8:
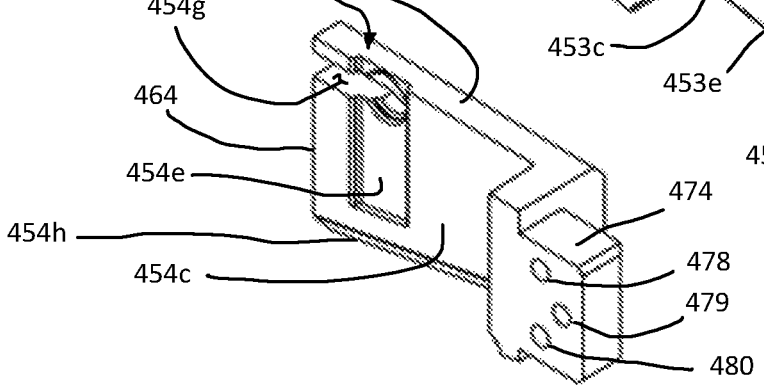
FIG. 8 is a front perspective view of an exemplary embodiment of another mount piece, shown separate from the other components.

Referring to FIGS. 7 and 8, the mount piece first body portion 453 and second body portion 454 are shown separate from the other components, with the joining piece 455 shown separately in FIG. 9.

Figure 18:
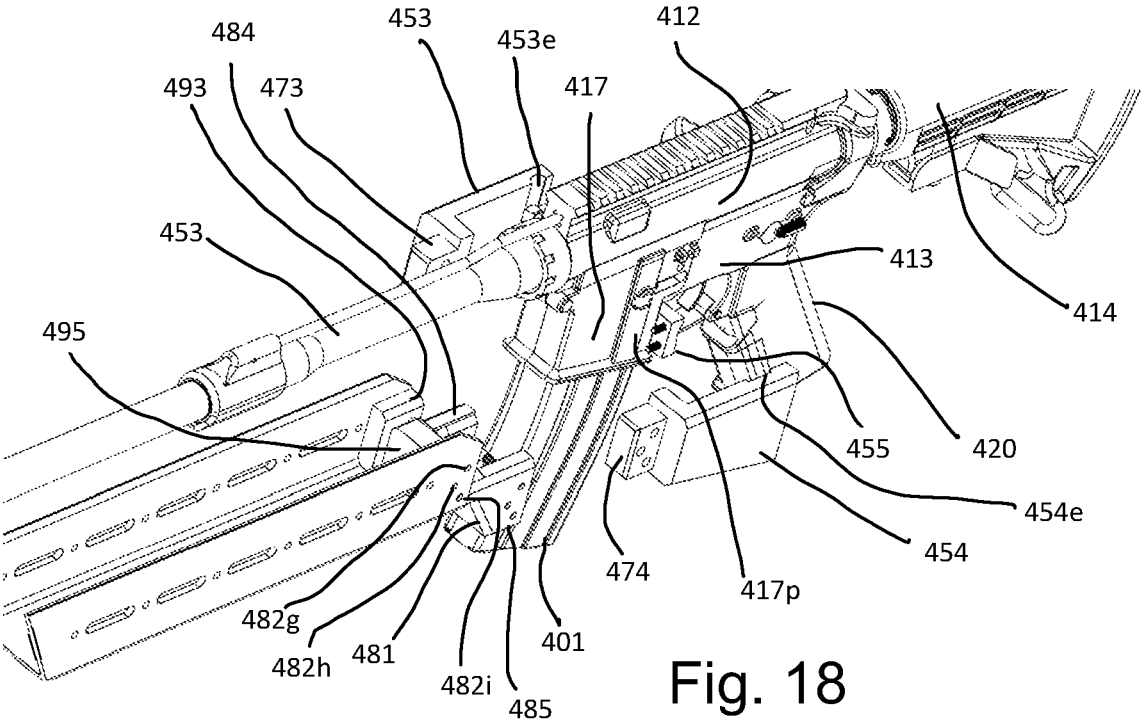
FIG. 18 is a left side perspective view showing the rifle of FIG. 5A, in partial view, as viewed from the top left, with the conversion components shown in an exploded view.

Referring to FIG. 7, the first body portion 453 is shown separate from the other components. The first body portion 453 is shown having a lateral side 453*a* with wall 453*b* having an inner surface 453*c* and an outer surface 453*d*. A recess 453*e* is shown provided in the wall 453*b*, and is recessed from the inner surface 453*c*. The recess 453*e* may be provided to accommodate the profile of a host rifle to which the mount piece 451 is to be installed. Accordingly, according to embodiments, the mount body portions 453 and 454 may include different wall profiles to accommodate the geometry of the host rifle. The first body portion 453 includes an angled or tapered bottom 453*h* at the lower edge of the wall 453*b*. A channel 453*f* is shown disposed in the flange 463 and communicating with the recess 453*e*. The first mount piece 473 has a front connecting flange 473. The front flange 473 is shown projecting outwardly from a front wall portion 453*g* of the wall 453*b*. In the exemplary embodiment illustrated, the front flanges 473 of the first body portion 453 and front flange 474 of the second body portion 454 (see FIG. 8), have a height that is less than the wall height of wall 453*b*. The flanges 473, 474 are configured to fit with an accessory or mounting component, such as the second mount piece 481. FIG. 8 shows the second body portion 454 of the mount piece 451. The second body portion 454 is configured similar to the first body portion 453, but includes a differently configured recess 454*e*, and has a slot 454*g* extending into the wall 454*b* from the rear flange portion 464. (For example, the rifle configuration shown in FIG. 18 illustrates a projection 417*p* that is accommodated by the recess 454*e* when the second mount piece 454 is installed on the magazine well 417. The second body portion 454 includes an angled or tapered bottom 454*h* at the lower edge of the wall 454*b*.

Referring to FIG. 9, the joining piece 455 is shown separate from the other components comprising a plate-like body 456 having a recess which is shown according to a preferred embodiment comprising a concavity or concave portion 457 spanning horizontally across the connector body 456, and provided on the connector body rear face 456*b*. The recess 457 provides clearance for accessing the trigger 429 when the joining piece 455 is installed on a rifle (see FIG. 6). The connector body spanning wall 456*c* preferably is set back relative to the front faces 456*a* that mate with the mount piece body portion flanges 463, 464. The set back space 456*d* is shown, and in the preferred implementations may receive a portion of the lower receiver magazine well therein. The joining piece 455 is shown having a plurality of counterbores 460, 461, 462, 463 in the connector body 456.

As shown in FIG. 5B, fastening means comprising fasteners, such as the screws 458, secure the joining piece 455 to the mount body portions 453, 454. The fastening means preferably comprise a suitable fastener for releasably securing the mount piece to the lower receiver 413. In the embodiment illustrated, the screws 458 are received in the counterbores 460, 461, 462, 463 of the connector body 456.

Figure 6:
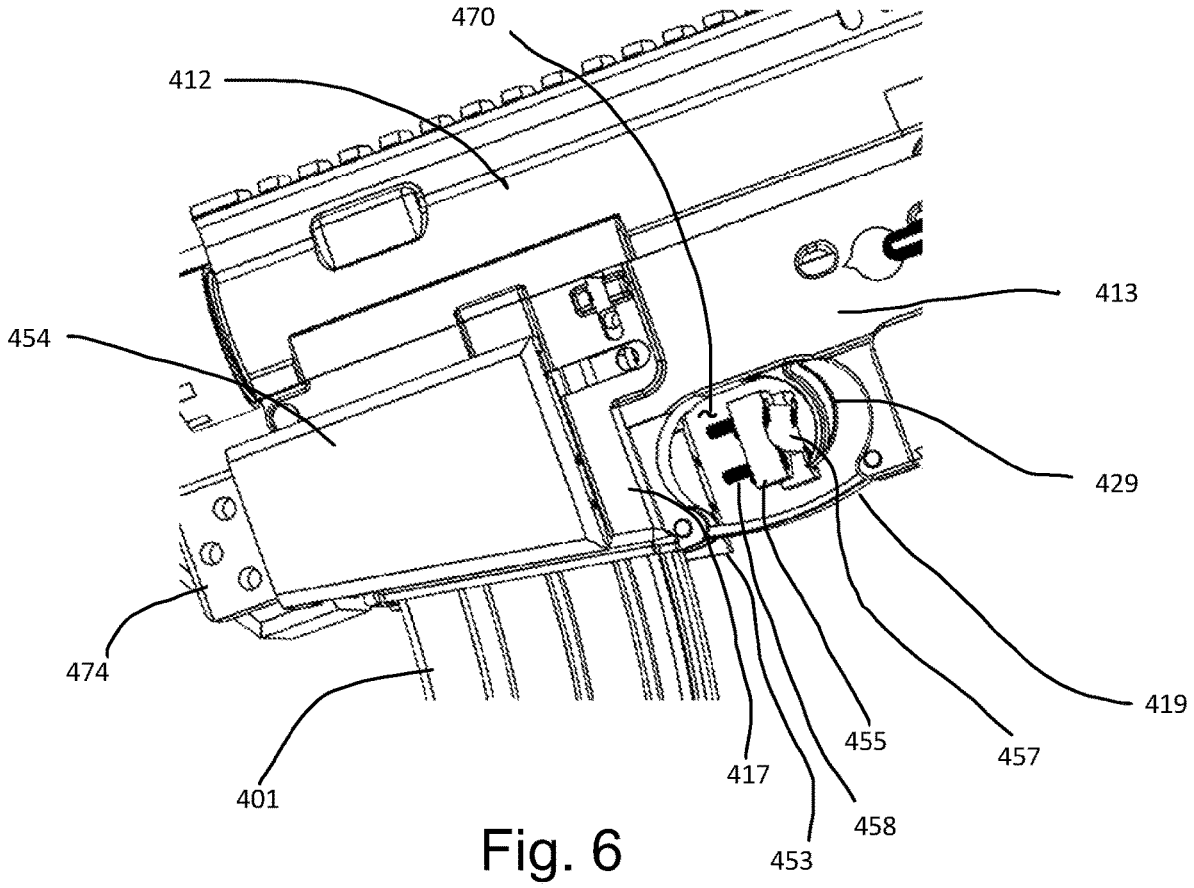
FIG. 6 is an enlarged partial view showing a portion of the left side of the rifle with device mount piece components detached in an exploded assembly view.

Referring again to FIG. 9, the connector plate-like body 456 has a front face 456*a* that is configured to mate with rear flange portions 463, 464 provided respectively at the end of each of the mount piece body portions 453, 454. Threaded bores 465, 466 are shown provided in the first mount piece body 453 (FIG. 7), and threaded bores 467, 468 are shown provided in the second mount piece body 454 (FIG. 8). As shown in FIG. 6, the joining piece 455 secures together the mount piece body portions 453, 454. The joining piece 455 is disposed passing within the trigger guard space 470, and secures the mount pieces 453, 454 to the magazine well 417 of the lower receiver 413.

Figure 10:
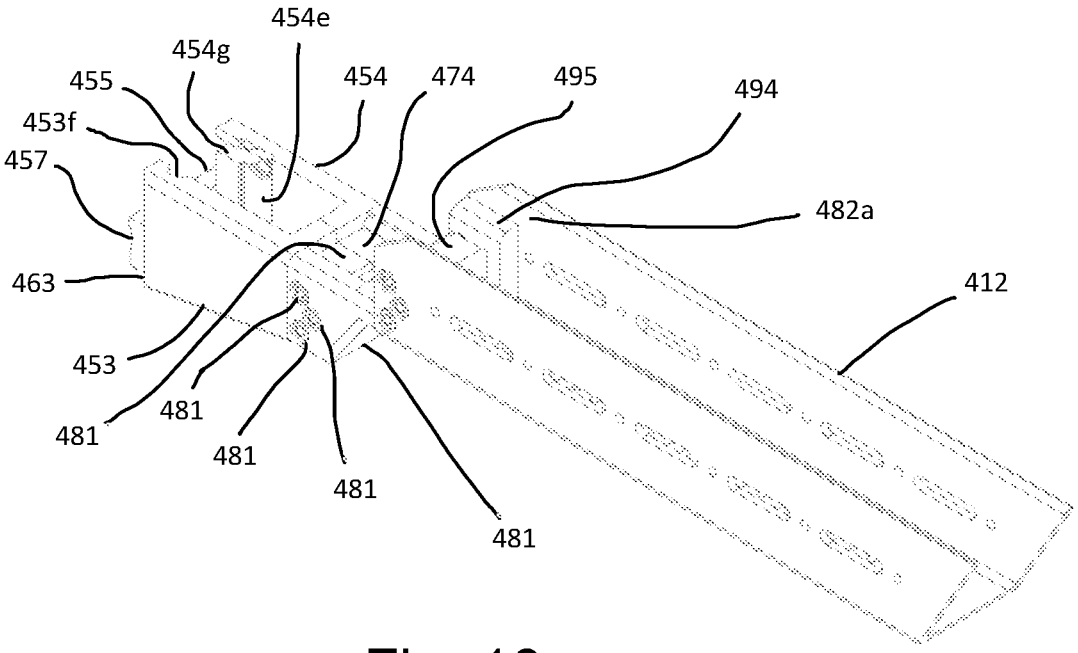
FIG. 10 is a perspective view, as viewed from the right and above, of a conversion device shown assembled and including a forearm or handguard, and being shown separate from a rifle.
Figure 11:
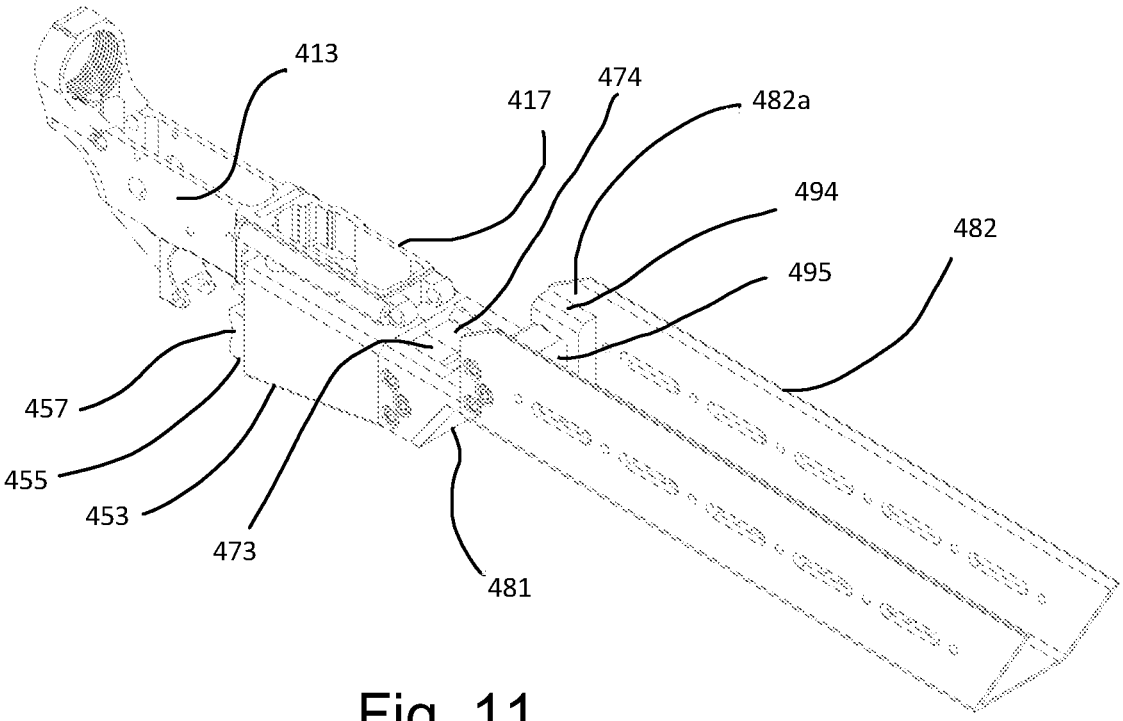
FIG. 11 is a perspective view of the conversion device shown in FIG. 10, installed on a lower receiver component.

Referring to FIGS. 10-13, the second mount piece 481 is shown in an arrangement mounting a forearm or handguard 482. The second mount piece 481 may comprise one or more components. In the embodiment illustrated, the handguard 482 is connected to the second mount piece 481, and the second mount piece 481 connects with the mount piece 451 formed by mount body portions 453, 454, and makes a releasable connection with the handguard 482. In FIG. 11, the components are shown installed on a lower receiver 413 (the lower receiver being shown separate from the other parts of the rifle).

In addition to the handguard 482, other components and accessories may be connected and supported with the mount piece 451. For example, a plurality of accessories or components may be connected to the mount piece 451 via the connecting flanges 473, 474. The handguard 482 may be replaced with other handguards or accessories, or in some instances, connection of multiple accessories may be accommodated, such as for example, a handguard and a bi-pod mount, which may be connected to a mount, such as the mount piece 451, or second mount piece 481.

Figure 17:
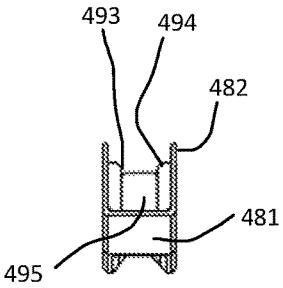
FIG. 17 is a front elevation view of the conversion device shown in FIG. 10.

Referring to FIGS. 14-17, the conversion component 450 of FIG. 10 is illustrated separate from a rifle to be converted, such as the rifle 410. The views of FIGS. 12-15, respectively, illustrate a top plan view (FIG. 14), a side elevation view (FIG. 15), a rear elevation view (FIG. 15), and a front elevation view (FIG. 17).

Figure 19:
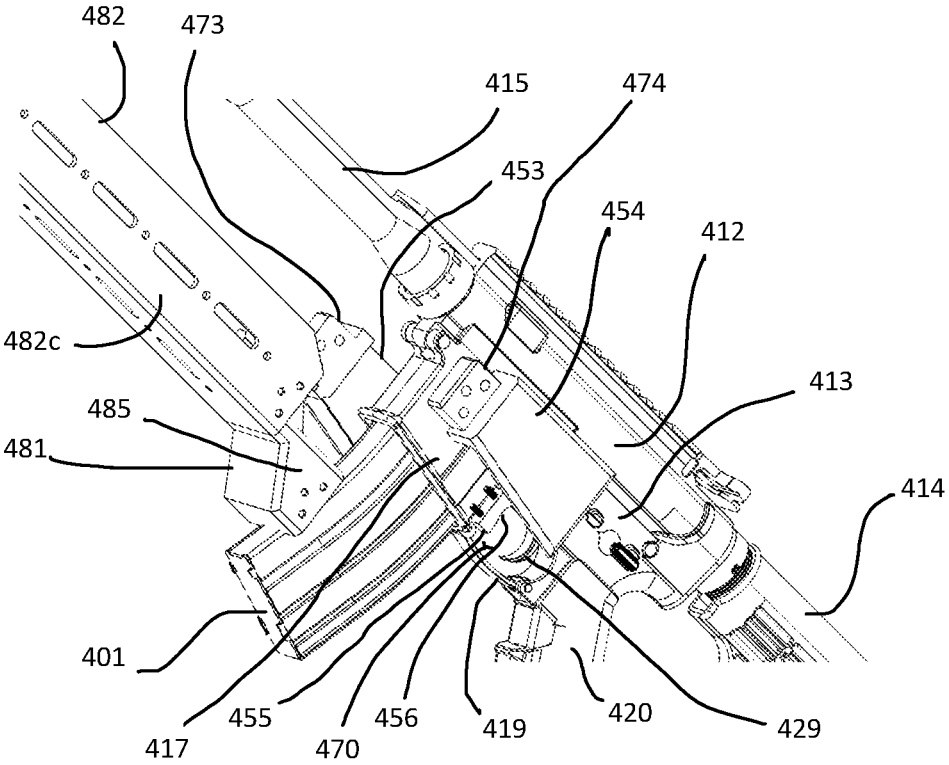
FIG. 19 is a left side perspective view showing the rifle and components of FIG. 18, as viewed from the bottom left in a partial view, with the conversion components shown in an exploded view.

Referring to FIGS. 18 and 19, the conversion is shown in a stage of assembly, with the conversion component comprising the mount piece first body portion 453 and second body portion 454, joining piece 455 and the second mount piece 481 shown comprising a mount for mounting the handguard 482. According to some alternate embodiments, the handguard 482 and second mount piece 481 may be installed as a single accessory component that is removably mountable on the mount piece 451.

Figure 12:
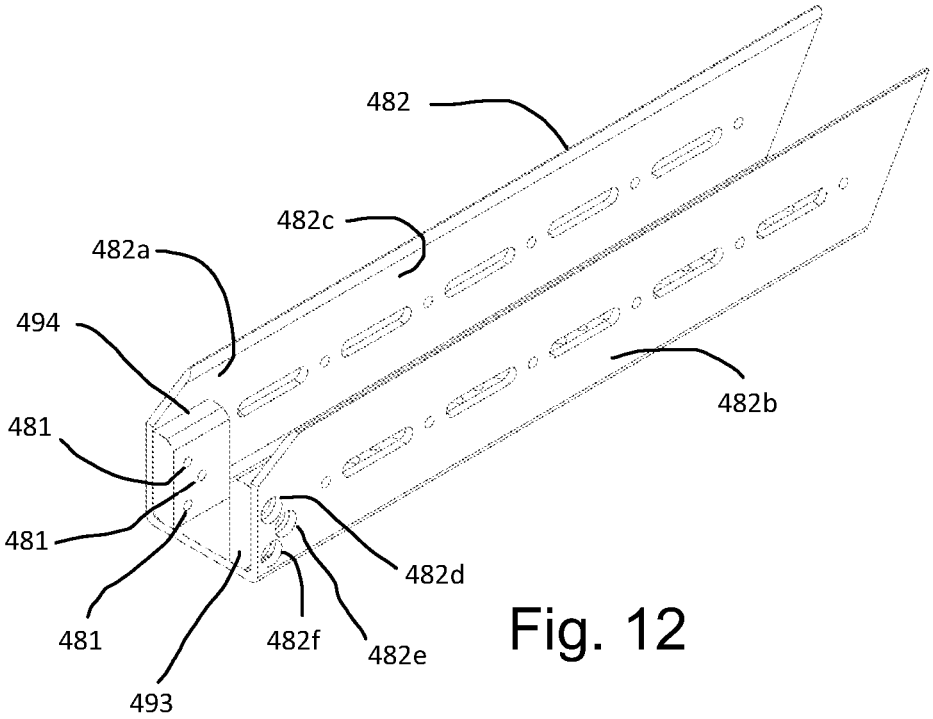
FIG. 12 is a perspective view of the handguard portion of the conversion device shown in FIG. 10, shown separate from the other components.
Figure 13:
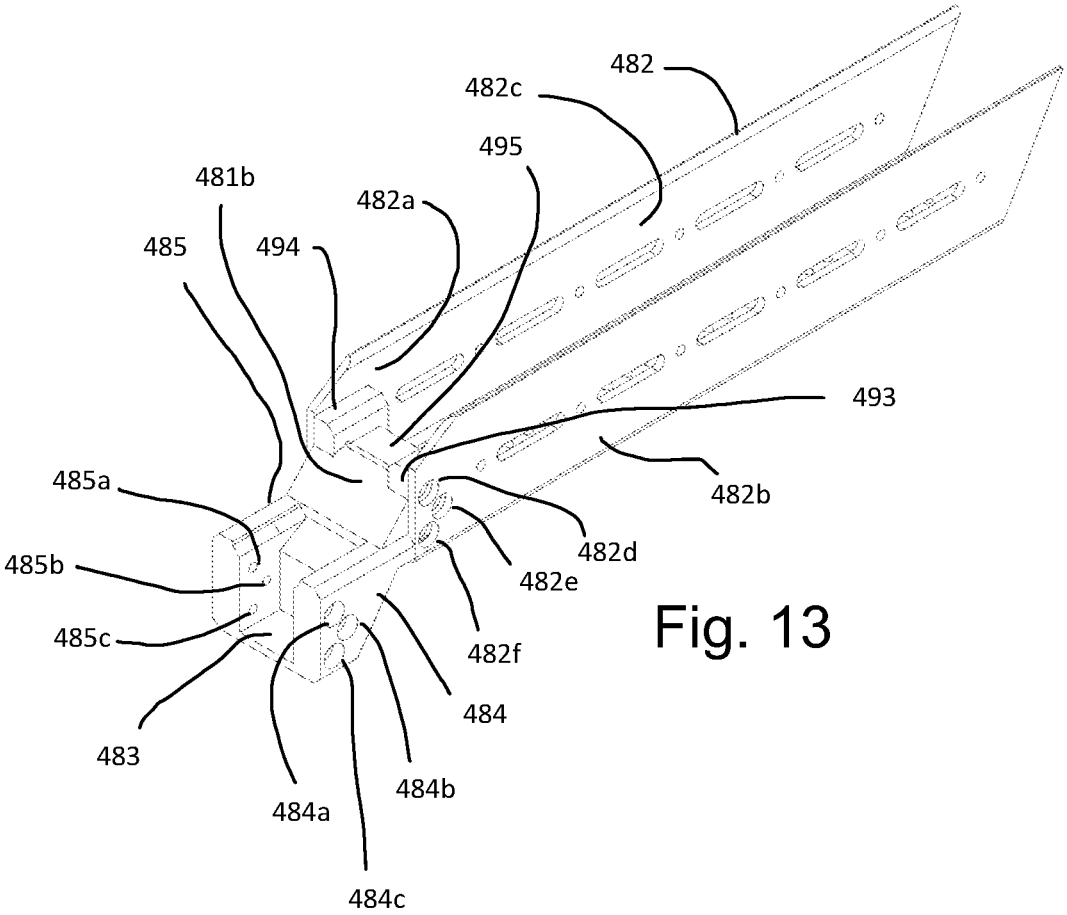
FIG. 13 is a perspective view of the handguard portion of the conversion device shown in FIG. 10, shown with a second mount piece.
Figure 14:
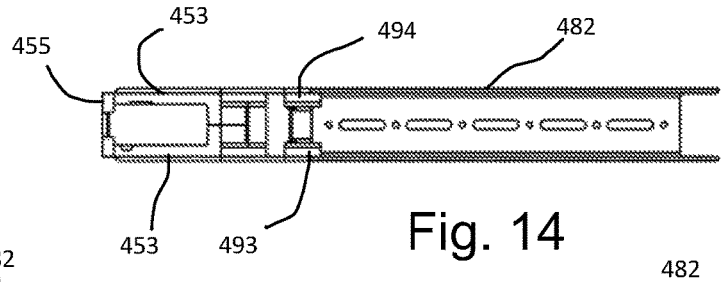
FIG. 14 is a top plan view of the conversion device shown in FIG. 10.
Figure 16:
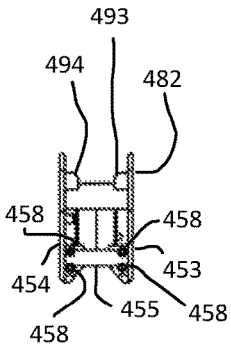
FIG. 16 is a rear elevation view of the conversion device shown in FIG. 10.
Figure 15:
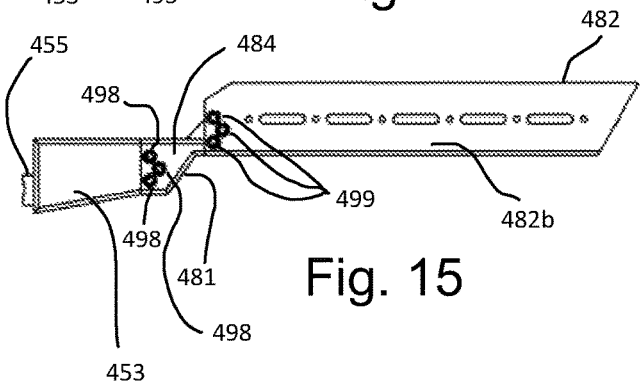
FIG. 15 is a right side elevation view of the conversion device shown in FIG. 10.

According to an exemplary embodiment illustrated, the second mount piece 481 is shown connected to the first mount piece 451. The second mount piece 481 includes a distal flange 495 which, as shown in FIG. 13, connects with the handguard 482. In the embodiment illustrated, the distal flange 495 is shown having a fastener which in this example, comprises a plurality of threaded bores (not shown) which align with a plurality of apertures 482*d*, 482*e*, 482*f* and 482*g*, 482*h*, 482*i* (FIG. 18) disposed respectively, in the walls 482*b*, 482*c* of the handguard 482. Fasteners, such as screws or bolts generally 499 (see FIGS. 15 and 5B) may be used to secure together the handguard 482 with the second mount 481 via the distal flange 495. In the depiction illustrated, the screws 498 are inserted through the handguard apertures 482*d*, 482*e*, 482*f* (FIGS. 12 and 13) and secure to the apertures (not shown) disposed in the distal flange 495 of the second mount piece 481 to secure the handguard 482 on one side thereof. Similarly, screws are provided to connect the handguard 482 to the distal flange 495 on the opposite handguard side, wherein screws are inserted through the apertures 482*g*, 482*h*, 482*i* of the handguard 482 (FIG. 18) to secure to apertures of the distal flange 495 of the second mount piece 481. The distal flange 495 may serve as a point of attachment for attachment of accessories to the rifle, other than the handguard 481. The second mount piece proximal flanges 484, 485 connect the second mount piece 481 to the first mount piece 451. In the embodiments illustrated, the proximal flanges 484, 485 fit on the mount piece front or connecting flanges 473, 474 (see FIGS. 5B, 10, 11, 18 and 19). For example, in accordance with a preferred embodiment, the proximal flanges 484, 485 are configured to form an extension of the mount piece 453 aligning with the mount piece outer surface 453*d*, 454*d* respectively.

In accordance with a preferred implementation, the first mount piece 451 is secured to the lower receiver of the rifle 410 by assembling the joining piece 455 to the first body portion 453 and second body portion 454 of the mount piece 451. Then the handguard piece 481 shown with the second mount piece 481 already attached thereto, is connected to the front flanges 473, 474 of the mount piece 451 with the fasteners (such as the screws 498 shown in FIG. 5B). Alternatively, the connections may be made in a different order as desired by the user, so that the assembly of the mount and desired accessory are installed.

In the embodiments illustrated, the accessory, such as the handguard 481, is connected to the rifle 410 via the mount piece 451. The mount piece 451 is secured to the lower receiver 413, and in the preferred embodiments is mounted to the magazine well 417. The handguard 482 is entirely supported on the lower receiver 413 via the mount piece 451 and does not engage or contact the other components of the rifle 410, such as the barrel 415 or upper receiver 412 or its components. In the embodiment illustrated, the handguard 482 is shown partially surrounding the barrel 415, on three sides thereof, but is spaced apart from the barrel 415, and does not make contact with it. Thus the accessory weight is carried solely by the lower receiver 413.

According to embodiments, the accessories, such as the handguard 482, or other accessories, may be mounted to the mount piece 451. According to some embodiments the mount piece 451 may include one or more mount piece connectors, such as the second mount piece 481 shown in conjunction with the mount piece 451 and handguard 482. Referring to FIGS. 12 and 13, the second mount piece 481 is shown having a mating configuration to connect with the attachment end 482*a* of the handguard 482, and, in the embodiment illustrated, the second mount piece 481 includes a first connecting portion shown comprising flanges 484, 485 that connect with the mount piece 451, and a second connecting portion 481*b* that connects with the accessory connector, such as the handguard mounts 493, 494 Referring to FIG. 13, the connecting portion flanges 484, 485 have apertures therein, respectively, 484*a*, 484*b*, 484*c*, and 485*a*, 485*b*, 485*c*, which preferably may be configured as counterbores for receiving screws or bolts therein. Referring to FIGS. 7 and 8 where the mount body portions 453 and 454 are shown separately, the respective apertures 475, 476, 477 in the mount body portion 453 and apertures 478, 479, 480 in the mount body portion 454, which preferably are threaded, receive matingly threaded screws 498 (FIG. 15) to connect with the connecting portion flanges 484, 485. The respective apertures 484*a*, 484*b*, 484*c*, and 485*a*, 485*b*, 485*c* of the respective flanges 484, 485 align with the mount body portion apertures 475, 476, 477 and 478, 479, 480.

Figure 20:
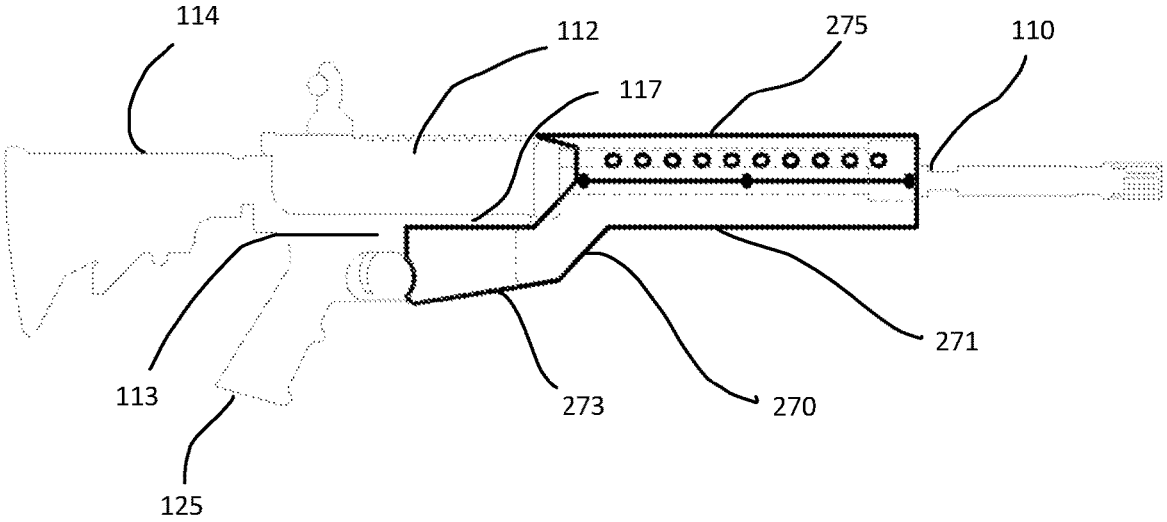
FIG. 20 is a right side elevation view of a rifle shown with an alternate embodiment of a conversion component that includes a forearm with an integrated top cover.

Referring to FIG. 20, a rifle 110 is shown with a conversion component comprising a mount piece 270 and having a forearm piece 271 with an integrated top cover 275 mounted to the rifle 110. In the embodiment shown in FIG. 20, the top cover 275 is provided as part of the forearm piece 271. The top cover 275 provides a cover for the lower gas tube or piston rod of the rifle 110. The top cover 275 may be an integral part of the forearm 271. For example, the forearm portion or piece 271 may be configured as a tube design if desired. According to some embodiments, the forearm piece 271 may be secured to the lower receiver 113 of the rifle 110 with a mount that may include one or more mount pieces that secure the forearm piece 271. For example, according to an exemplary embodiment, a mount piece 270 is shown which includes a mounting portion 273 shown fitted on the magazine well 117. The forearm piece 271 may be mounted to the lower receiver 113 using the mounting mechanisms shown and described herein in connection with the other embodiments. According to some alternate embodiments, the forearm piece 271 and integrated top cover 275 may be provided with one or more mount pieces that may be integrated, so that the forearm piece 271 and cover 275 include an integrated mount configured to be secured to the rifle lower receiver 113, and more particularly, on the magazine well 117. The forearm piece 271 and top cover 275 are supported by the lower receiver 113, and the top cover 275 is not supported by or on the upper receiver 112 or upper receiver components of the rifle.

Figure 21:
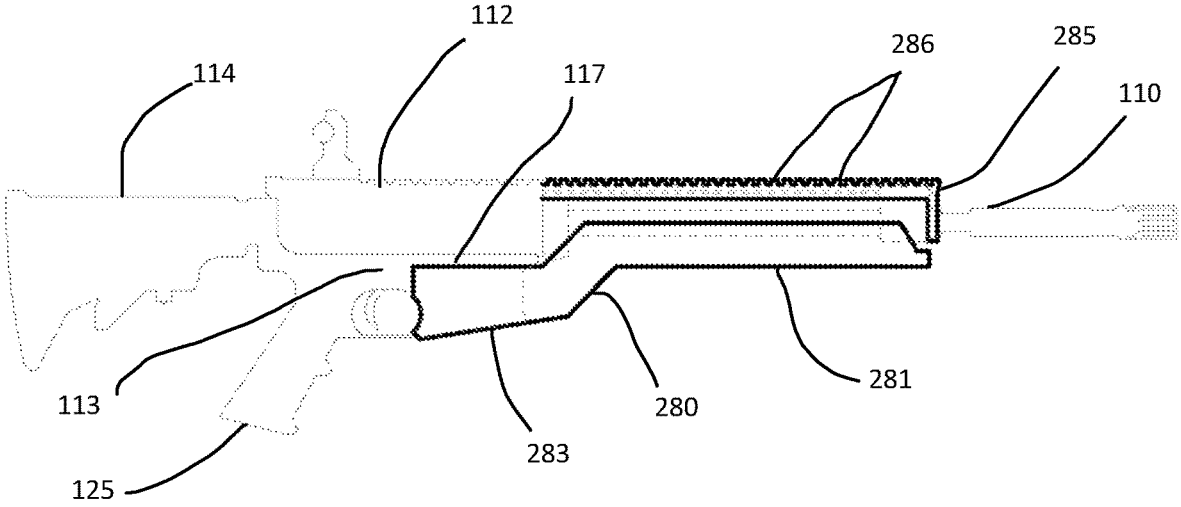
FIG. 21 is a right side elevation view of a rifle shown with an alternate embodiment of a conversion component that includes a forearm with a separate top cover.
Figure 27:
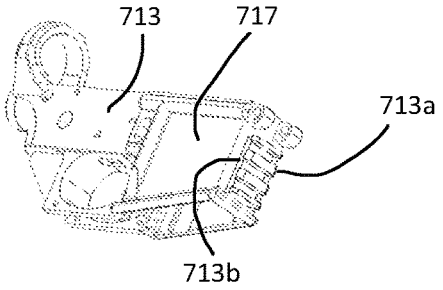
FIG. 27 is a perspective view, looking from below at the right side, of an alternate embodiment of a conversion device according to the invention, showing a lower receiver configured with a picatinny rail mounting feature to connect with accessories.
Figure 28:
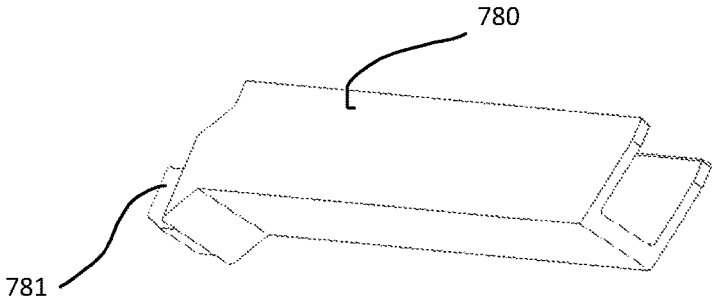
FIG. 28 is an exemplary accessory shown comprising a forearm configured for mounting to the lower receiver of FIG. 27.
Figure 29:
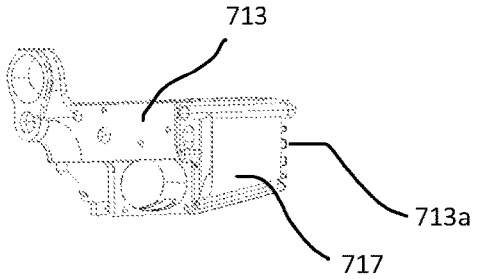
FIG. 29 is another perspective view of the lower receiver of FIG. 27 shown from a different angle.
Figure 30:
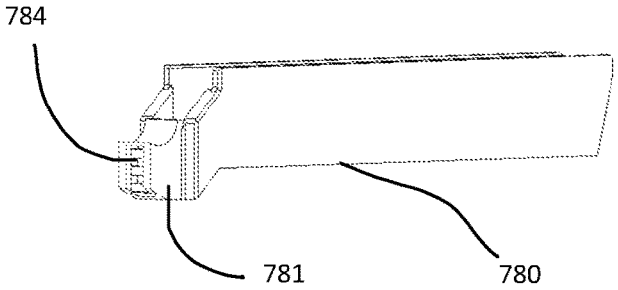
FIG. 30 is another perspective view of the forearm piece of FIG. 28 shown from a different angle.
Figure 31:
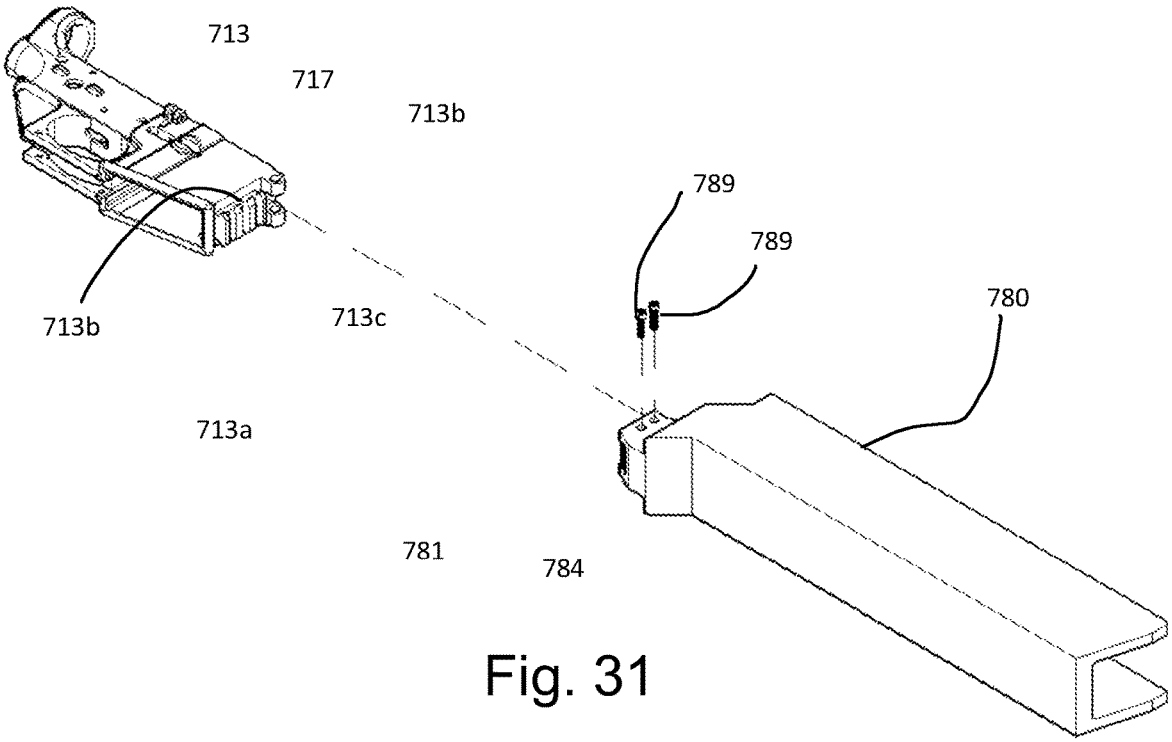
FIG. 31 is an exploded assembly view in perspective showing the lower receiver of FIGS. 27 and 29 connecting with the forearm piece of FIGS. 28 and 30.

Referring to FIG. 21, a right side elevation view of a rifle 110 shown with an alternate embodiment of a conversion component 280 that includes a forearm 281 with a separate top cover 285. A mount piece 283 is shown securing the conversion component 280 to the rifle lower receiver 113 and more particularly on the magazine well 117. The top cover 285 includes picatinny rails 286 along its length. An alternative arrangement is depicted in FIG. 21, where the top cover 285 is attached to the upper receiver subassembly 112. For example, the arrangement in FIG. 21 may provide an advantageous alternative to users with two-piece handguards on their upper receivers. The bottom piece of a traditional multi-piece (or two-piece) handguard may be removed to provide for the conversion component to is installed and allow the conversion component to provide a forearm for use to improve the rifle configuration. The arrangement depicted in FIG. 21 also may be advantageous to users desiring to keep the overall assembly weight lower to eliminate a larger tube-style forearm component.

Referring to FIGS. 22-26, an alternate embodiment of a device comprising a conversion component is shown having a mount piece that is integrated with a rifle lower receiver 613. In the embodiment illustrated, the forearm piece 680 includes a mounting flange 681 shown with fastening means comprising a plurality of threaded bores 682 configured to receive matingly threaded screws 689 therein. The lower receiver 613 is shown having a plurality of apertures, which preferably are counterbores that the threaded screws are passed through to secure the forearm flange 681. Although the screws 689 are shown between the lower receiver 613 and forearm flange 681, the installation to mount and remove the forearm piece 680 is carried out by inserting the screws 689 on the inner space 617*a* of the magazine well 617 of the lower receiver 613. Although the fastening means is shown comprising screws 689 and threaded bores 682, other suitable fasteners may be used to provide a removable connection to secure and release the forearm piece 680 to the lower receiver 613.

Referring to FIGS. 27-31, an alternate embodiment of a device comprising a conversion component is shown having a mount piece that is integrated with a rifle lower receiver 713. In the embodiment illustrated, the forearm piece 780 includes a mounting flange 781 shown with fastening means comprising picatinny rails 784 disposed on the mounting flange 781. Matingly associated picatinny rails 713*a* are shown provided on the lower receiver mount portion 713*b*.

The fastening means, in addition to the picatinny rails 784, 713*a* may also include additional fasteners, such as screws 789 that may secure the forearm 780 to the lower receiver 713 along with the rails 784, 713*a*. The mount portion 713*b* of the lower receiver 713 may be provided with threaded bores for receiving the screws 789. For example, the forearm flange 781 may be configured to use picatinny rails as well as the apertures 713*b*, 713*c* of the lower receiver 713.

Figure 32:
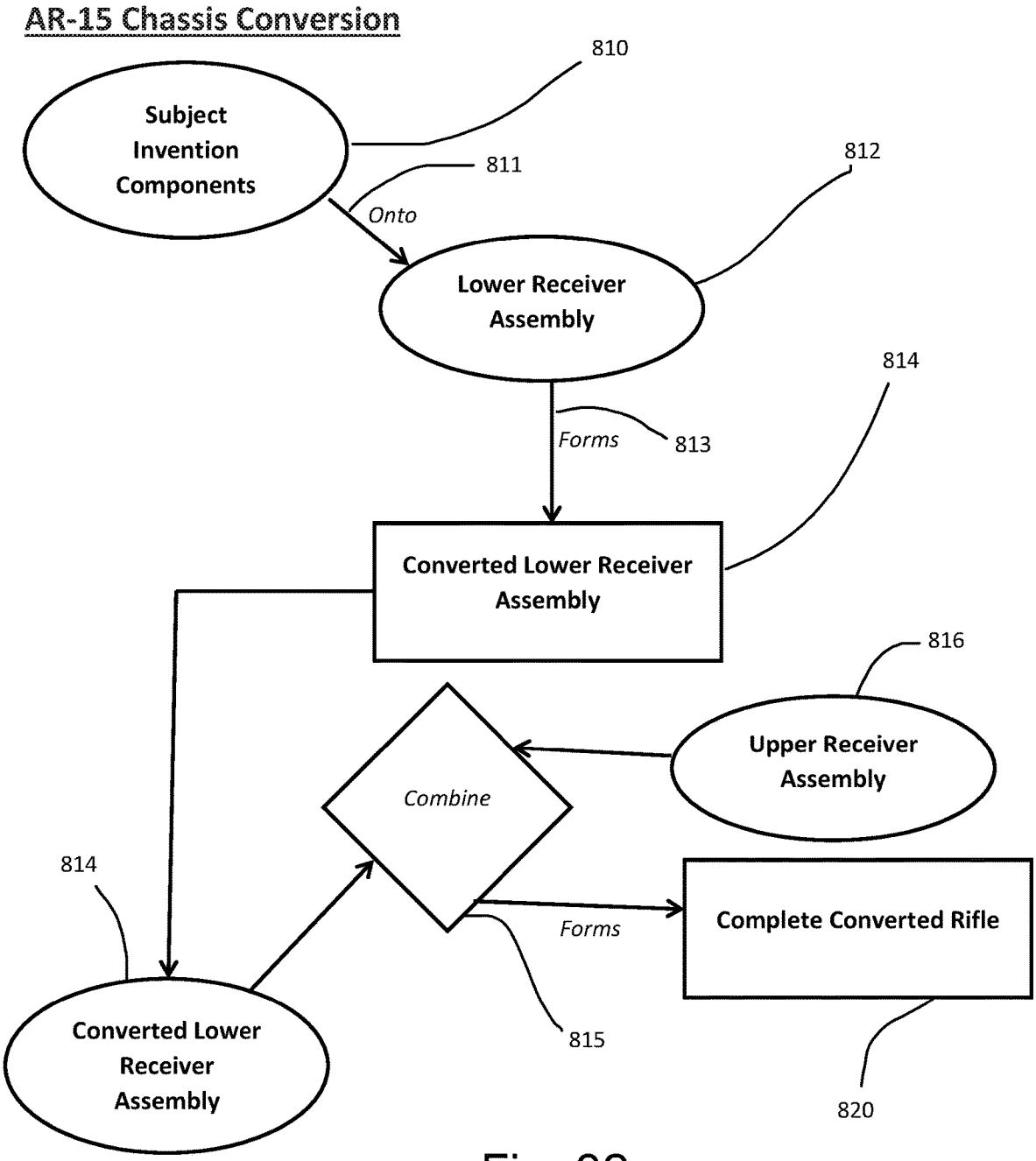
FIG. 32 is a schematic depiction of an implementation of an exemplary method for converting a rifle according to the invention to attach and detach accessories.
Figure 33:
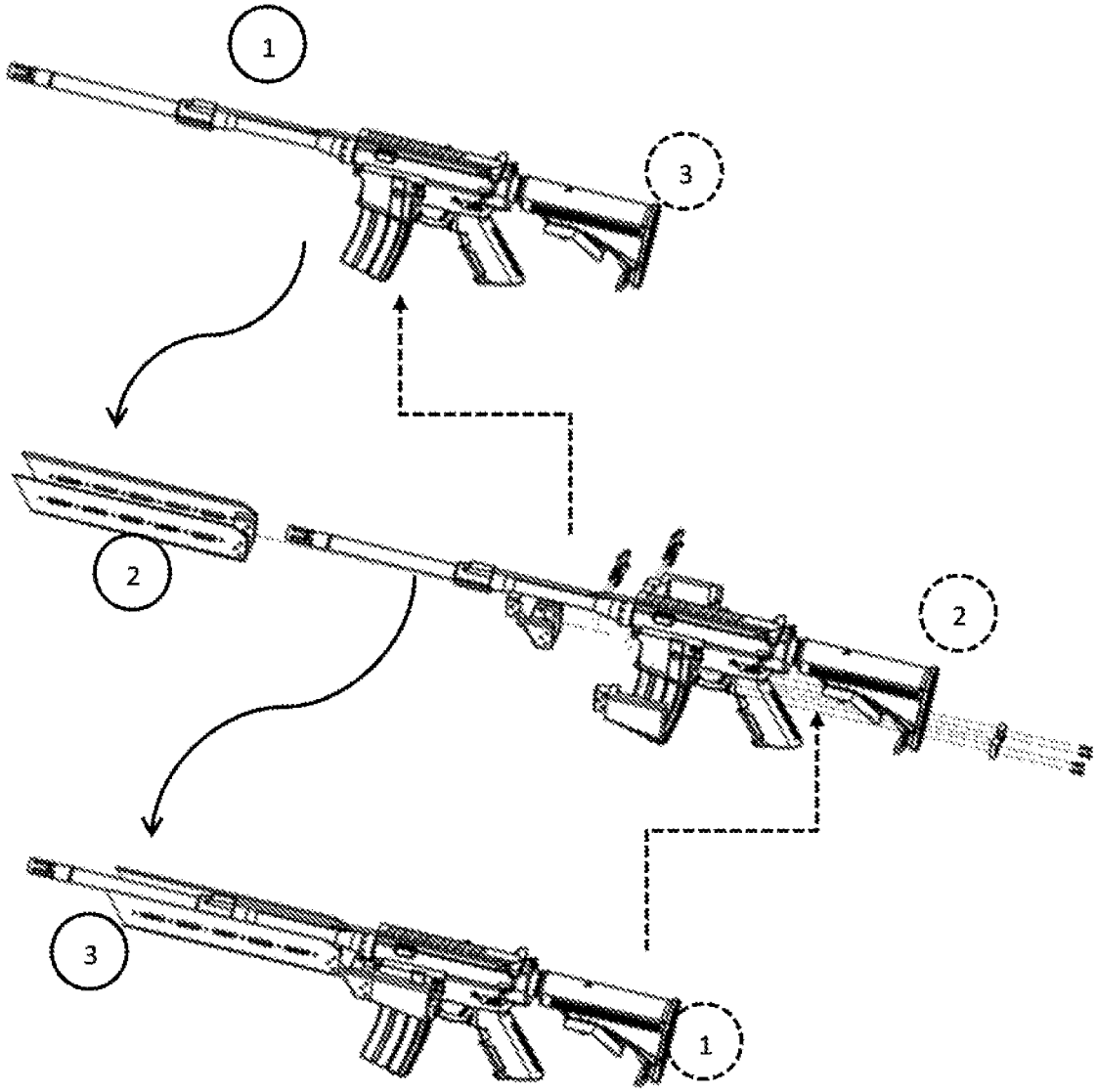
FIG. 33 is a diagram illustrating the conversion of a rifle from a forward conversion to a reverse configuration state.

Referring to FIG. 32 a flow diagram of an exemplary depiction of the method for converting a rifle is shown. The conversion component or components are provided 810 and are installed 811 on the lower receiver assembly 812. When secured on the lower receiver assembly the conversion components form 813 a converted lower receiver assembly 814. The converted lower receiver assembly 814 is then combined 815 preferably with an upper receiver 816 to form the converted rifle 820. As depicted in the embodiments, the rifle 110, 310, 410 may be converted by providing a conversion component, such as the mount 451 on the rifle lower receiver. FIG. 33 shows a diagram illustrating the conversion of a rifle from a forward conversion to a reverse configuration state. Preferred embodiments install the conversion component, such as the mount 451 on the magazine well (417). The mount 451 has a plurality of portions that assemble together, and in the depictions includes a first portion 453 and second portion 454 which are secured together with the joining piece 455 to clamp onto the magazine well 417 of the lower receiver 413. A suitable fastening mechanism such as for example, screws and matingly threaded bores are shown, although alternative fastening mechanisms may be employed, such as a ratchet or other connector. The mount remains secured during the normal operations of the firearm, as user desired to be present. The mount 451 may remain connected and a handguard 482 may be attached and removed from the mount 451 as desired by the user. According to a preferred implementation, a second mount piece 481 is provided to connect the handguard 481 to the mount piece 451. The second mount piece 481 is shown raising the height of the point of connection for the handguard 482 to provide a desired installation location for seating the handguard 482 when installed. The second mount piece 481 may be provided to mount other accessories, including one or more accessories together. When the accessory is no longer desired to be present or used, it may be detached. The accessory may be detached from the second mount 481, or removed along with the second mount 481. The mount 451 may be permitted to remain on the lower receiver, or it may be removed. The mount piece is connected and secured to the lower receiver to remain connected thereon for as long as the user desires, and including remaining connected during operation of the firearm to which the mount piece is attached. The mount piece therefore remains connected during firing, maneuvering and other manipulations of the firearm.

The mount piece and conversion devices shown herein, according to some alternate embodiments, may be configured with one or more cut-outs, slots, or recesses to accommodate or allow access to features of the host firearm being converted.

The mount piece, although shown according to some preferred embodiments as being formed from a plurality of components, according to some alternate embodiments, may be formed from a single component that is securable to the lower receiver. For example, the first and second mount body portions may be provided as a single component body that is connectable to the lower receiver, and preferably for example, the magazine well. According to some embodiments, the connector or plate may pass through the trigger space to secure the mount body to the rifle. According to some alternate embodiments, a first mount piece may be integrally provided with a second mount piece. According to some other embodiments, the integrally provided mount piece or pieces may include an integrally provided accessory, such as a handguard.

The conversion components, such as the mount and mount body pieces comprising the mount, may be installed using a clamping force that clamps the mount and/or mount pieces onto the lower receiver. For example, the screws shown may be used to apply a clamping force by securing together the mount pieces on the lower receiver, and according to some embodiments, on the magazine well portion of the lower receiver. The mount pieces preferably are secured against movement so the rifle and any attachments may be carried by or on the user, or be transported and operated in a stable form. Although the mount piece is shown in preferred embodiments being removably connectable to the lower receiver, according to some alternate embodiments, the mount piece may be provided as part of the lower receiver, and include a detachable mounting surface or connector for connecting another component, such as a forearm or handguard, or other accessory, which when installed, provides the capability to operate the firearm without touching the upper receiver or an accessory carried on or mounted to the upper receiver. The devices, such as the conversion components, such as for example, the mount pieces, as well as the forearm, may be constructed from a suitable material, such as metal or other suitable material, and preferably a material that is resistant to corrosion, water, and can withstand weather elements and conditions. According to some embodiments, the material may comprise a plastic material or material that may be extruded, injection molded, 3D printed, or other forming process or procedure. Plastic and alterative materials may be used to reduce the weight of the conversion components such as the mount pieces, as well as of the accessories, such as a forearm piece, cover, or other connectable accessory.

While the invention has been described with reference to specific embodiments, the description is illustrative and is not to be construed as limiting the scope of the invention. Various modifications and changes may occur to those skilled in the art without departing from the spirit and scope of the invention described herein and as defined by the appended claims.

What is claimed is:

1. In a rifle having a receiver assembly comprising an upper receiver assembly including an upper receiver and action components and a barrel having a barrel forend, and a lower receiver assembly that includes a lower receiver and fire controls, the lower receiver including a magazine well and a trigger guard forming a loop disposed behind the magazine well, the improvement comprising: a conversion adapter comprising a removable mount piece that is removably securable to the magazine well, wherein when said mount piece is connected to said lower receiver the mount piece does not contact the upper receiver, wherein the mount piece comprises an accessory connector that is configured to releasably connect with one or more accessories to mount the one or more accessories to the rifle via the accessory connector, wherein said accessory connector provides a point of connection for connecting said one or more accessories to the rifle, and wherein said point of connection is located in front of the magazine well;

wherein the mount piece, when attached to the rifle, engages multiple surfaces of the lower receiver, including surfaces of the magazine well; and wherein the mount piece is removably securable to the magazine well and includes a mounting connector that is disposed in the loop.

2. The rifle of claim 1, wherein the one or more accessories are supported only on the lower receiver, and do not engage with the upper receiver.

3. The rifle of claim 2, wherein said one or more accessories comprises a handguard.

4. The rifle of claim 1, further comprising a fastener that is adjustably tensionable to provide a clamping force to releasably secure said mount piece to said surfaces of the magazine well.

5. The rifle of claim 1, further comprising a fastener that is adjustably tensionable to provide a clamping force to removably secure the removable mount piece to said lower receiver.

6. The rifle of claim 5, wherein said mount piece comprises a first mount body section and a second mount body section which are joined to form the accessory connector.

7. The rifle of claim 6, wherein said first mount body section and said second mount body section each include a rear flange and a front flange, wherein a joining piece joins the rear flanges of the respective first and second mount body sections.

8. The rifle of claim 1, wherein said mount piece includes a mount body and a mounting plate, the mount body including at least one flange that includes thereon the accessory connector that is configured to connect with the one or more accessories.

9. The rifle of claim 8, wherein said at least one flange is a front flange, and wherein said mount body has at least one rear flange, and wherein said plate is configured to connect with said at least one rear flange of said mount body.

10. The rifle of claim 9, including a fastener that fastens the plate to said at least one rear flange of said mount body.

11. The rifle of claim 9, wherein said at least one rear flange of said mount body comprises at least two rear flanges, and wherein said plate is securable to said at least two rear flanges.

12. The rifle of claim 9, wherein said mount body includes at least another front flange, and wherein said two front flanges of the mount body join together to form the accessory connector that is configured to connect with the one or more accessories, wherein said mount body engages the surfaces of the magazine well.

13. The rifle of claim 1, wherein said mount piece comprises a plurality of portions securable to the magazine well.

14. A method for converting a rifle that has a receiver assembly comprising an upper receiver assembly including an upper receiver and action components and a barrel, and a lower receiver assembly that includes a lower receiver and fire controls, the lower receiver having a plurality of surfaces and including a magazine well, the upper receiver assembly and the lower receiver assembly forming an original configuration of the rifle, comprising:

a) removably installing a conversion device onto the lower receiver by attaching the conversion device to the rifle by engaging multiple surfaces of the plurality of surfaces of the lower receiver, including surfaces of the magazine well, with the conversion device to removably fix the conversion device onto the magazine well;

b) wherein the conversion device includes or is configured to connect with one or more accessories that do not contact the upper receiver assembly;

c) wherein said conversion device is supported on said lower receiver only and does not contact the upper receiver assembly; and d) detaching the conversion device from the rifle to restore the rifle to the original configuration;

e) wherein, when the conversion device is detached from the magazine well, the rifle remains free of the conversion device;

f) wherein the conversion device comprises a mount piece, and wherein removably installing the conversion device comprises installing the mount piece onto the magazine well of the lower receiver by engaging the multiple surfaces of the plurality of surfaces of the lower receiver, including the surfaces of the magazine well, with the mount piece;

g) wherein the magazine well comprises a wall, and wherein installing the mount piece onto the magazine well of the lower receiver comprises installing the mount piece to the magazine well wall;

h) wherein said mount piece comprises a plurality of portions securable to the magazine well wall; and i) wherein the rifle includes a trigger guard with a trigger guard space, and wherein at least one of said plurality of mount piece portions securable to the magazine well wall passes through the trigger guard space.

15. The method of claim 14, wherein said plurality of mount piece portions include at least one first mount portion, at least one second mount portion and a plate, wherein one of the at least one first mount portion and the at least one second mount portion is securable to the magazine well wall, passes through the trigger guard space, and comprises the plate, and wherein said plate connects together the at least one first mount portion and the at least one second mount portion.

16. The method of claim 15, including attaching at least one of said one or more accessories to said mount piece.

17. The method of claim 16, including detaching at least one of said one or more accessories from said mount piece.

18. The method of claim 14, including attaching at least one of said one or more accessories to said mount piece.

19. The method of claim 18, including detaching at least one of said one or more accessories from said mount piece.

20. The method of claim 14, wherein said one or more accessories are removable accessories, and wherein the mount piece includes a front flange, and wherein said front flange is configured to connect with said removable accessories.

21. The method of claim 14, wherein said one or more accessories are removable accessories, and wherein said mount piece includes at least one of said removable accessories.

22. The method of claim 14, wherein the plurality of portions of the mount piece comprises a first mount portion and a second mount portion, and wherein installing the mount piece includes connecting together said first mount portion and said second mount portion, wherein when connected together, said first mount portion and said second mount portion engage the surfaces of the magazine well and form a connecting point at the front of the magazine well for connecting with said one or more accessories.

23. The method of claim 14, wherein the conversion device further comprises a fastener that is adjustably tensionable to provide a clamping force to removably secure the mount piece to said lower receiver, and adjusting the fastener to removably secure and release the conversion device to the lower receiver.

24. The method of claim 14, wherein said plurality of portions of said mount piece comprises a first mount body section and a second mount body section that join to form an accessory connector; and forming the accessory connector by joining the first mount body section and the second mount body section.

25. The method of claim 24, wherein said first mount body section and said second mount body section each include a rear flange and a front flange, wherein a joining piece joins the rear flanges of the respective first and second mount body sections, and joining the rear flanges of the respective first and second mount body sections.

26. The method of claim 14, wherein said plurality of portions of said mount piece includes a mount body and a mounting plate, the mount body including at least one flange that includes thereon an accessory connector that connects with the one or more accessories, and connecting the one or more accessories to the accessory connector.

27. The method of claim 26, wherein said at least one flange is a front flange, and wherein said mount body has at least one rear flange, and wherein said plate connects with said at least one rear flange of said mount body, and connecting said plate with said at least one rear flange of said mount body.

28. The method of claim 27, wherein the conversion device comprises a fastener, and wherein said plate is connected with said at least one rear flange of said mount body using the fastener.

29. The method of claim 27, wherein the at least one rear flange of said mount body comprises at least two rear flanges, and securing said plate to said at least two rear flanges.

30. The method of claim 27, wherein said mount body includes at least another front flange, and joining said two front flanges of the mount body together to form the accessory connector that connects with the one or more accessories, wherein said mount body engages the surfaces of the magazine well when the two front flanges of the mount body are joined together.

* * * * *